US006987712B2

(12) United States Patent
Ono et al.

(10) Patent No.: US 6,987,712 B2
(45) Date of Patent: Jan. 17, 2006

(54) ANALOG CHRONOGRAPH TIMEPIECE HAVING PLURAL MOTORS

(75) Inventors: Tamotsu Ono, Chiba (JP); Mamoru Watanabe, Chiba (JP); Yuichi Shino, Chiba (JP); Kei Hirano, Chiba (JP)

(73) Assignee: Seiko Instruments Inc., Chiba (JP)

( * ) Notice: Subject to any disclaimer, the term of this patent is extended or adjusted under 35 U.S.C. 154(b) by 227 days.

(21) Appl. No.: 10/463,718

(22) Filed: Jun. 17, 2003

(65) Prior Publication Data

US 2004/0008586 A1 Jan. 15, 2004

(30) Foreign Application Priority Data

Jun. 18, 2002 (JP) ..... 2002-176925

(51) Int. Cl.
*G04F 10/00* (2006.01)

(52) U.S. Cl. ..... 368/110; 368/111; 368/112; 368/113; 368/220; 368/223

(58) Field of Classification Search ..... 368/110–113, 368/220, 223
See application file for complete search history.

(56) References Cited

U.S. PATENT DOCUMENTS 4,250,572 A * 2/1981 Yoshida ..... 368/71
4,623,260 A * 11/1986 Kamiyama ..... 368/80
4,623,261 A * 11/1986 Muto ..... 368/80
4,744,066 A * 5/1988 Schwartz ..... 368/76
5,155,711 A * 10/1992 Schwartz ..... 368/80
5,289,452 A * 2/1994 Sakamoto et al. ..... 368/73
5,369,627 A * 11/1994 Ikegami ..... 368/88
6,804,172 B2 * 10/2004 Matoge et al. ..... 368/220

FOREIGN PATENT DOCUMENTS

EP 0493613 7/1992
EP 1085384 3/2001

OTHER PUBLICATIONS

Berney J C: "Quelques Variations Sur La Base Des Mouvements Eta De La Serie 251" Jahrbuch der Deutschen Gesellschaft fur Chronometrie, Deutschen Gesellschaft fur Chronometrie E.V. Stuttgart, DE, vol. 43, 1992, pp. 135-137, XP000316314 ISSN; 0373-7616.

* cited by examiner

*Primary Examiner*—Daniel J. Colilla
*Assistant Examiner*—Andrea H. Evans
(74) *Attorney, Agent, or Firm*—Adams & Wilks

(57) ABSTRACT

An analog chronograph timepiece has a main plate and a setting stem for correcting time information. Defined at the main plate are a reference vertical axis line passing through the rotational center of the main plate and disposed parallel to a central axis line of the setting stem, and a reference horizontal axis line passing through the rotational center of the main plate and disposed orthogonal to the main plate reference vertical axis line. The main plate has regions disposed relative to the reference vertical and horizontal lines and in which a time coil block and first and second chronograph coil blocks are selectively arranged.

28 Claims, 16 Drawing Sheets

ANALOG CHRONOGRAPH TIMEPIECE HAVING PLURAL MOTORS

BACKGROUND OF THE INVENTION

1. Field of the Invention

The present invention relates to an analog chronograph timepiece having plural motors. Particularly, the invention relates to an analog chronograph timepiece having a movement constituted to be able to arrange a chronograph second hand at a center of a movement and to be able to arrange the chronograph second hand also at a position other than the center of the movement in the analog chronograph timepiece.

2. Description of the Prior Art

Generally, a movement (machine body including a drive portion) of an analog electronic timepiece includes a main plate constituting a base plate of the movement. In an analog electronic timepiece, with respect to both sides of the main plate, a side having a dial is referred to as "back side" and a side thereof opposed to the side having the dial is referred to as "surface side" of the movement. A train wheel integrated to the "surface side" of the movement is referred to as "surface train wheel" and a train wheel integrated to the "back side" of the movement is referred to as "back train wheel".

The "surface side" of the movement is arranged with a battery, a circuit block, a motor, the surface train wheel and the like. Generally, the surface train wheel includes a fifth wheel & pinion, a second wheel & pinion, a third wheel & pinion and a center wheel & pinion (minute wheel & pinion) and the like. Generally, the motor is constituted by a step motor and includes a coil block, a stator and a rotor. In the analog electronic timepiece, the train wheel is rotated by driving the rotor. The rotor includes a rotor magnet and a rotor pinion (indicating a portion other than the rotor magnet in the rotor, the same as follows).

The "back side" of the movement is arranged with the back train wheel and the like. Generally, the back train wheel includes a setting wheel, an hour wheel, a minute wheel and the like. Further, a switching apparatus is arranged at the "surface side" or the "back side" of the movement. Generally, the switching apparatus includes a setting lever, a yoke, a yoke holder and the like. Further, as a hand setting mechanism, a hand setting stem, a clutch wheel, a setting wheel and the like are provided. The analog electronic timepiece is constituted such that when the step motor is operated, the train wheel is rotated by rotation of the rotor, "hour" of current time is indicated by an hour hand and "minute" of current time is indicated by a minute hand.

Further, an analog chronograph timepiece is constituted such that when the step motor is operated, the train wheel is rotated by rotation of the rotor, "second in elapse time" is indicated by a chronograph second hand, "minute in elapse time" is indicated by a chronograph minute hand, "second in elapse time" is indicated by a chronograph second hand and "hour in elapse time" is indicated by a chronograph hour hand. Further, there is also known an analog chronograph timepiece in which "time measured by a unit of one tenth second in elapse time" is indicated by one tenth chronograph second hand and/or "time measured by a unit of one fifth second in elapse time" is indicated by a one fifth chronograph second hand.

An electronic timepiece disclosed in JP-A-63-149586 is arranged with a motor and a train wheel for indicating time at a central portion of a movement and arranged with a motor and a train wheel for operating a five hundredth chronograph secondhand, a motor and a train wheel for operating a chronograph second hand and a motor and a train wheel for operating a chronograph minute hand at an outer peripheral portion of the movement at intervals of about 90 degrees.

According to an electronic timepiece with chronograph disclosed in JP-A-61-83992, a second hand arranged with a rotation center at a central portion of a movement is made to indicate normal time and chronograph time by operating an outside operating member. Further, a train wheel for driving a second hand is constituted to operate a chronograph minute hand and a chronograph hour hand.

A chronograph timepiece disclosed in JP-A-55-160890 is provided with a chronograph secondhand arranged with a rotation center thereof at a central portion of a movement, a chronograph minute hand arranged with a rotation center thereof in a 9 o'clock direction of a dial and a chronograph hour hand arranged with a rotation center thereof in a 12 o'clock direction of the dial. Further, a motor and a wheel train for operating the chronograph second hand, a motor and a train wheel for operating the chronograph minute hand and a motor and train wheel for operating the chronograph hour hand are arranged at an outer peripheral portion of the movement.

A chronograph timepiece disclosed in JP-A-55-7662 is provided with a timepiece mechanism for operating an indicator for indicating time and a chronograph mechanism for operating a chronograph hand. According to the chronograph timepiece, a rotation center of a chronograph second hand is arranged at a central portion of a movement and a rotation center of a second hand for timepiece is arranged at a middle of the central portion and an outer peripheral portion of the movement.

According to a conventional analog chronograph timepiece, a chronograph time piece having a structure in which a chronograph second hand is arranged at a center of a movement (hereinafter, referred to as "center chronograph timepiece") and a chronograph timepiece having a structure in which a chronograph second hand is arranged at a position other than a center of a movement (hereinafter, referred to as "side chronograph timepiece") are quite different from each other in dimensions, shape and arrangement of parts for constituting the respective movements, particularly, main plate, bridge member (train wheel bridge or the like), step motor and wheel train.

Therefore, according to the conventional analog chronograph time piece, when "center chronograph timepiece" and "side chronograph timepiece" are fabricated, respective movements need to design quite separately from each other and respective movements need to fabricate by steps quite different from each other. Therefore, there is a problem that a time period for designing the movements is substantially high, steps of fabricating the movements become complicated and a number of steps for fabricating the movements is increased.

Further, it is necessary to store constant amounts or numbers of constituent parts of the "center chronograph timepiece" and constituent parts of "side chronograph timepiece" respectively as stocks and therefore, there are problems in which a storage location is necessary for the parts and in which the operational burden of after service is enhanced.

SUMMARY OF THE INVENTION

It is an object of the invention to provide a chronograph timepiece having a movement constituted to be able to arrange a chronograph second hand at a center of a movement of a chronograph timepiece and also be able to arrange the chronograph second hand at a position other than the center of the movement of a chronograph timepiece in an analog chronograph timepiece.

The invention is constituted by an analog chronograph timepiece including a main plate constituting a base plate of a movement, a bridge member for supporting a part constituting the movement, a time information indicating wheel rotated with a main plate center of the main plate as a rotation center for indicating time information, a hand setting stem for correcting to indicate the time information, a switching apparatus for switching a position of the hand setting stem and a dial for indicating the time information, wherein the main plate includes bearing portions of a rotor and a train wheel used in fabricating a "center chronograph timepiece" by using the movement and bearing portions of a rotor and a train wheel used in fabricating a "side chronograph timepiece" by using the movement, and the bridge member includes bearing portions of the rotor and the train wheel used in fabricating the "center chronograph timepiece" by using the movement and bearing portions of the rotor and the train wheel used in fabricating the "side chronograph timepiece" by using the movement.

According to the analog chronograph timepiece, the rotor and the train wheel used in fabricating the "side chronograph timepiece" are rotatably integrated to the bearing portions of the main plate and the bearing portions of the bridge member. The analog chronograph timepiece is characterized in that the time information is constituted to indicate by a time indicating member rotated with the main plate center as a rotation center, and a result of measuring a chronograph is constituted to indicate by a chronograph indicating member rotated with a position between the main plate center and an outer shape portion of the main plate as a rotation center.

Further, the analog chronograph timepiece of the invention is characterized in being constituted such that the rotor and the train wheel used in fabricating the "center chronograph timepiece" are rotatably integrated to the bearing portions of the main plate and the bearing portions of the bridge member, the time information is constituted to indicate by a time indicating member rotated with the main plate center as a rotation center and other time indicating member rotated with a position between the main plate center and an outer shape portion of the main plate as a rotation center, and a result of measuring a chronograph is constituted to indicate by a chronograph indicating member rotated with the main plate center as a rotation center and other chronograph indicating member rotated with a position between the main plate center and the outer shape portion of the main plate as a rotation center.

Further, according to the analog chronograph timepiece of the invention, a main plate reference vertical axis line passing the main plate center and in parallel with a central axis line of the hand setting stem and a main plate reference horizontal axis line passing the main plate center and orthogonal to the main plate reference vertical axis line are defined at the main plate, the main plate is provided with a first region disposed on one side of the main plate reference vertical axis line and on a side of the main plate reference horizontal axis line proximate to the hand setting stem, provided with a second region disposed on other side of the main plate reference vertical axis line and on the side of the main plate reference horizontal axis line proximate to the hand setting stem, provided with a third region disposed on the other side of the main plate reference vertical axis line where the second region is present and on a side of the main plate reference horizontal axis line remote from the hand setting stem and provided with a fourth region disposed on the one side of the main plate reference vertical axis line where the first region is present and on the side of the main plate reference horizontal axis line remote from the hand setting stem.

The analog chronograph timepiece of the invention is characterized in that a coil block center of a time coil block for side provided for operating a motor and a train wheel for indicating the time information is arranged at the third region, a coil block center of a first chronograph coil block provided for operating a motor and a train wheel for indicating a result of measuring a chronograph is arranged at the third region, a coil block center of a second coil block provided for operating a motor and a train wheel for indicating other result of measuring the chronograph is arranged at the fourth region, and the coil block center of the first chronograph coil block is arranged on an outer side of the coil block center of the time coil block for side in the third region.

The analog chronograph timepiece of the invention is characterized in that a rotation center of a time rotor provided for operating a train wheel for indicating the time information is arranged at the third region, a rotation center of a first chronograph rotor provided for operating a first train wheel for indicating a result of measuring a chronograph is arranged at the third region, a rotation center of a second chronograph rotor provided for operating a second train wheel for indicating other result of measuring the chronograph is arranged at the fourth region, and the rotation center of the first chronograph rotor is arranged on an outer side of the rotation center of the time rotor in the third region.

Further, the analog chronograph timepiece of the invention is characterized in that a coil block center of a time coil block for center provided for operating a motor and a train wheel for indicating the time information is arranged at the fourth region, a coil block center of a first chronograph coil block provided for operating a motor and a train wheel for indicating a result of measuring a chronograph is arranged at the third region, a coil block center of a second coil block provided for operating a motor and a train wheel for indicating other result of measuring the chronograph is arranged at the third region, and the coil block center of the first chronograph coil block is arranged on an outer side of the coil block center of the second coil block at the third region.

Further, the analog chronograph timepiece of the invention is characterized in that a rotation center of a time rotor provided for operating a train wheel for indicating the time information is arranged at the fourth region, a rotation center of a first chronograph rotor provided for operating a first train wheel for indicating a result of measuring a chronograph is arranged at the third region, a rotation center of a second chronograph rotor provided for operating a second train wheel for indicating other result of measuring the chronograph is arranged at the third region, and the rotation center of the first chronograph rotor is arranged on an outer side of the rotation center of the second chronograph rotor (446) in the third region.

It is preferable in the analog chronograph timepiece of the invention that a crystal unit and/or IC (integrated circuit) are arranged at the second region on a surface side of the movement.

Further, it is preferable in the analog chronograph timepiece of the invention that a battery is arranged to overlap the main plate reference horizontal axis line between the first region and the fourth region.

BRIEF DESCRIPTION OF THE DRAWINGS

A preferred form of the present invention is illustrated in the accompanying drawings in which.

DETAILED DESCRIPTION OF THE PREFERRED EMBODIMENTS

A mode for carrying out the invention will be explained as follows in reference to the drawings.

(1) First Embodiment

A first embodiment of an analog chronograph timepiece of the invention will be explained as follows. The first embodiment of the invention is "side chronograph timepiece" of a center three hands type.

(1•1) Total Constitution of Movement and Definition of Technical Term

First, a total constitution of a movement of an analog chronograph timepiece according to the invention will be explained.

Figure 1:
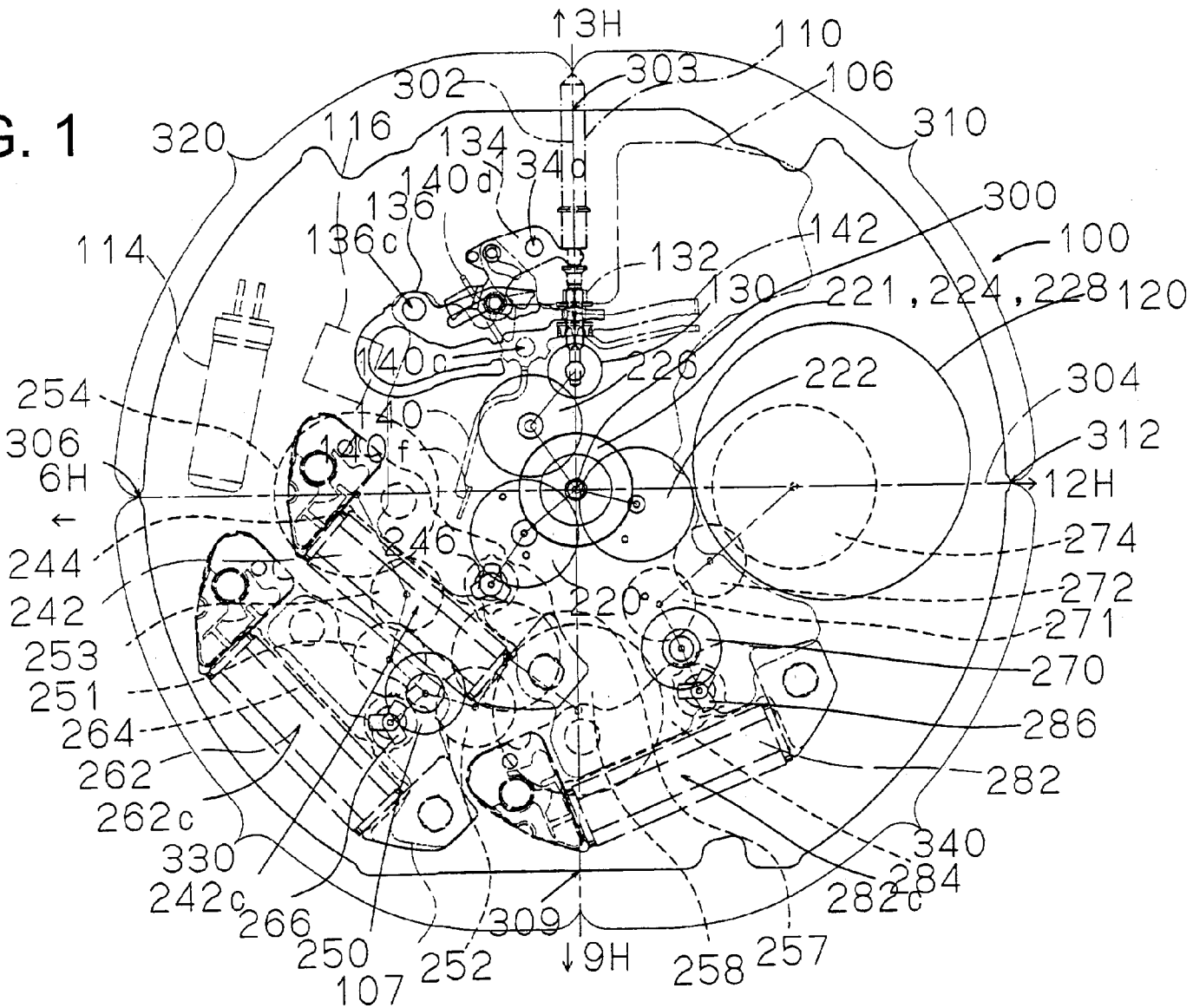
FIG. 1 is a plane view showing an outline shape by viewing a movement of a side chronograph timepiece from a surface side according to an embodiment of a chronograph timepiece of the invention (in FIG. 1, illustration of portions of parts are omitted and bridge members are indicated by imaginary lines)
Figure 2:
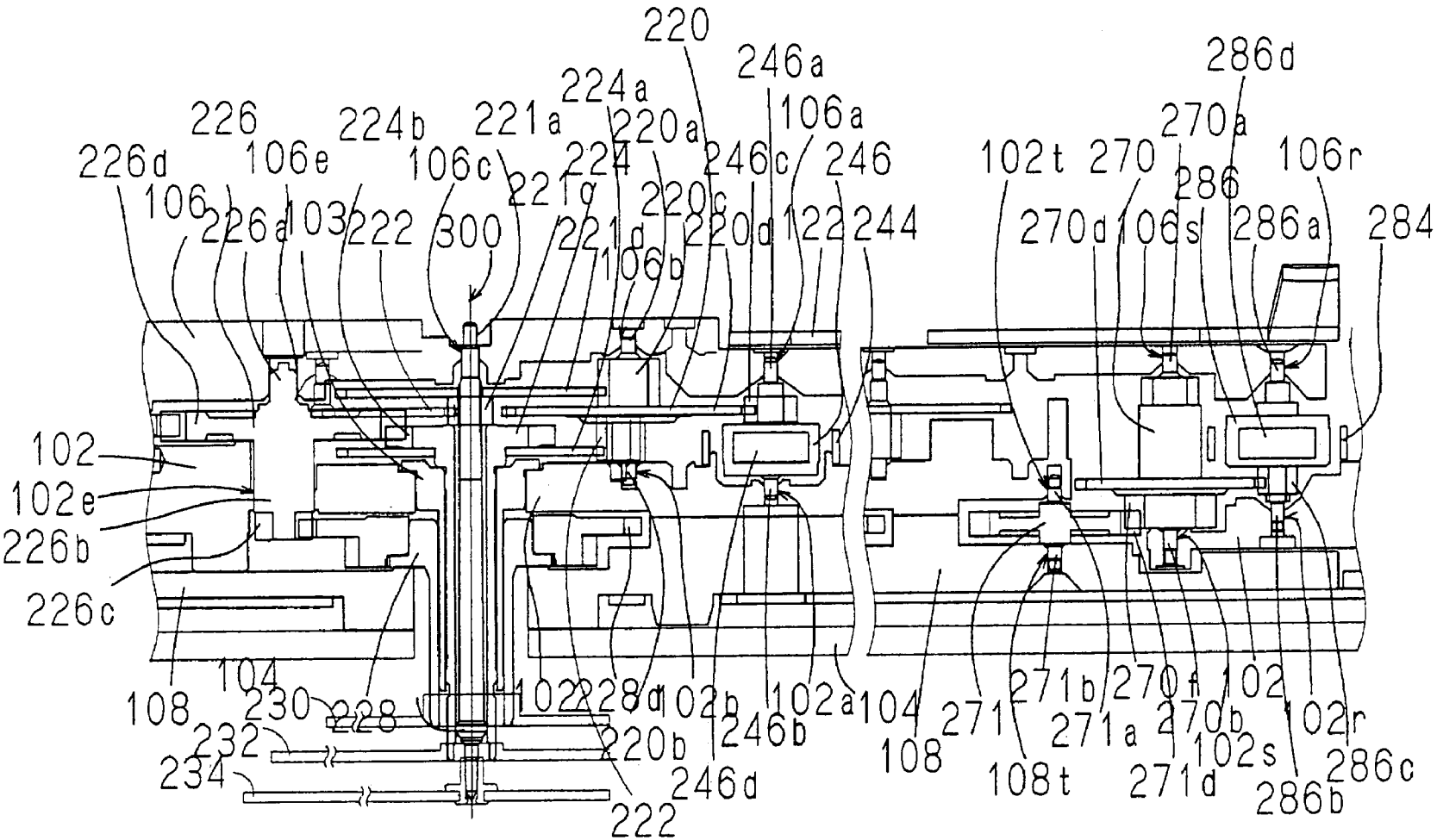
FIG. 2 is an outline partial sectional view showing a motor and a portion of a train wheel of the movement of the side chronograph timepiece according to the embodiment of the chronograph timepiece of the invention.
Figure 3:
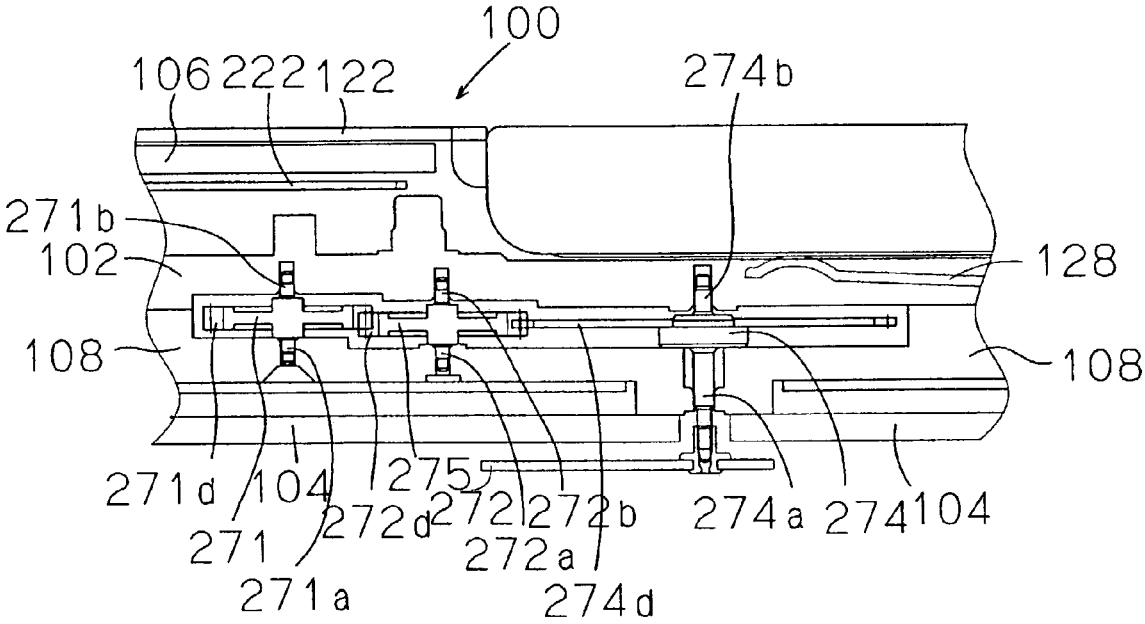
FIG. 3 is an outline partial sectional view showing a battery and a portion of the train wheel of the movement of the side chronograph timepiece according to the embodiment of the chronograph timepiece of the invention.

In reference to FIG. 1 through FIG. 3, an analog chronograph timepiece according to the invention is provided with a movement 100. The movement 100 includes a main plate 102 constituting a base plate thereof. According to the embodiment of the invention, an outer shape of the main plate 102 is substantially circular. Further, the outer shape of the main plate 102 may be other shape of a quadrangular shape, a polygonal shape, an elliptical shape or the like. It is preferable that the outer shape of the main plate 102 is a circular shape in which a portion of the outer shape is cut as shown by FIG. 1.

According to the Embodiment of the invention, a motor, a surface train wheel portion (including a motor for driving a surface train wheel and a surface train wheel), a battery, a circuit block, and a switching apparatus are arranged in the movement 100 on a side opposed to a side having a dial 104 with the main plate 102 as a reference, that is, on a surface side of the movement 102 (main plate 102). A back train wheel bridge 108 is arranged on the side having the dial 104 with the main plate 102 as a reference.

The switching apparatus includes a hand setting stem 110 for correcting time information, a clutch wheel 132 capable of rotating a setting wheel 130 by rotation of the hand setting stem 110, a setting lever 134 and a yoke 136. The movement 100 is formed with an irregular portion of the yoke 136. The movement 100 is formed with an irregular portion of the yoke 136 to be able to pull the hand setting stem 110 to a first stage. By spring force of a spring portion of the yoke 136, the irregular portion of the yoke 136 is pressed to a side face of a front end portion of the setting lever 134. By this construction, a position of the setting lever 134 is determined, further, setting weight of the hand setting stem 110 is set.

According to an analog chronograph timepiece, in assuming a state of attaching the dial 104 to the movement 100, a direction directed from a center 300 of the movement 100 to a 12 o'clock graduation of the dial 104 is referred to as "12 o'clock direction" (indicated as "12H" in FIG. 1), a direction directed from the center 300 of the movement 100 to a 3 o'clock graduation of the dial is referred to as a "3 o'clock direction" (indicated in FIG. 1 as "3H"), a direction directed from the center 300 of the movement 100 to a 6 o'clock graduation of the dial is referred to as "6 o'clock direction" (indicated in FIG. 1 as "6H") and a direction directed from the center 300 of the movement 100 to a 9'clock graduation of the dial is referred to as "9 o'clock direction" (indicated in FIG. 1 as "9H").

The hand setting stem 110 is rotatably integrated to the main plate 102. A rotation axis line of the hand setting stem 110 is arranged to coincide with a straight line directed from the center 300 of the movement 100 to "3 o'clock direction".

In FIG. 1, at the main plate 102, a main plate reference vertical axis line 302 passing a rotation center 300 (hereinafter, referred to as "main plate center 300") of a center wheel & pinion for side 224 and in parallel with a center axis line of the hand setting stem 110 and a main plate reference horizontal axis line 304 passing the main plate center 300 and orthogonal to the main plate reference vertical axis line 302 are defined. At the main plate 102, a first region 310 is provided to dispose at a position on one side of the main plate reference vertical axis line 302 and on a side of the main plate reference horizontal axis line 304 proximate to the hand setting stem 110. At the main plate 102, a second region 320 is provided to dispose at a position on other side of the main plate reference vertical axis line 302 and on the side of the main plate reference horizontal axis line 304 proximate to the hand setting stem 110. At the main plate 102, a third region 330 is provided to dispose at a position on the other side of the main plate reference vertical axis line 302 where the second region 320 is present and on a side of the main plate reference horizontal axis line 304 remote from the hand setting stem 110. At the main plate 102, a fourth region 340 is provided to dispose at a position on the one side of the main plate reference vertical axis line 302 where the first region is present and on the side of the main plate reference horizontal axis line 304 remote from the hand setting stem 110.

Although in FIG. 1, the first region 310 and the fourth region 340 are defined on the right side of the main plate reference vertical axis line 302, as a modified example, the first region 310 and the fourth region 340 may be defined to dispose on the left side of the main plate reference vertical axis line 302. In this case, the second region 320 and the third region 330 are defined to dispose on the right side of the main plate reference vertical axis line 302.

(1•2) Constitution of Train Wheel Portion for Indicating Time

Next, a constitution of a train wheel portion for indicating time will be explained. The train wheel portion for indicating time includes a train wheel driving motor for indicating time and a train wheel for indicating time.

In reference to FIG. 1 through FIG. 3, "surface side" of the movement 100 is arranged with a circuit block, a battery 120, a surface train wheel portion for side, a chronograph minute/second train wheel portion, a 1/10 second train wheel portion, a switching apparatus and so on. The main plate 102, a train wheel bridge 106 and a train wheel bridge 107 constitute support members. A center pipe 103 is fixed to the main plate 102 with the main plate center 300 as a center axis. A center wheel & pinion for side 224 is rotatably integrated to a center hole of the center pipe 103. The center wheel & pinion for side 224 includes a center wheel for side 224*a* and a cannon pinion for side 224*b*. The center wheel for side 224*a* is integrated to the cannon pinion for side 224*b* slippably relative to the cannon pinion for side 224*b*. An outer periphery of a cylindrical portion of the cannon pinion for side 224*b* is rotatably integrated to the center hole of the center pipe 103. The center wheel for side 224*a* is disposed between the main plate 102 and the train wheel bridge (A) 106. The center wheel for side 224*a* is constituted to rotate integrally with the cannon pinion for side 224*b*.

A surface train wheel portion for side includes a surface wheel train driving motor for side, that is, a time motor for side and an hour indicating train wheel for side. By rotation of the time motor for side, the hour indicating train wheel for side is rotated, "hour" in current time is constituted to indicate by an hour hand 230, "minute" in current time is constituted to indicate by a minute hand 232 and "second" in current time is constituted to indicate by a second hand 234.

A crystal unit 114 and IC (integrated circuit) 116 are attached to a circuit block (not illustrated). The circuit block is fixed to the main plate 102, the train wheel bridge (A) 106 and the train wheel bridge (B) 107 by a switch spring 122 via an insulating plate (not illustrated). The battery 120 is constituted by a silver battery, a lithium battery or the like to constitute a power source of the analog chronograph timepiece. As the power source of the analog chronograph timepiece, a chargeable secondary battery may be used or a chargeable capacitor may be used. A crystal oscillator in the crystal unit 114 constitutes an oscillation source of the analog chronograph time piece and is oscillated at, for example, 32, 768 Herz. A battery minus terminal 128 is constituted to conduct a cathode of the battery 120 and a minus input portion of IC 116 via a minus pattern of the circuit block. In a time indicating mode, IC (Integrated Circuit) 116 is constituted to measure current time and operate the time motor for side.

The time motor for side includes a time coil block for side 242, a time stator for side 244 and a time rotor for side, that is, a time rotor (A) 246. When a time motor drive signal outputted by IC (Integrated Circuit) 116 is inputted to the time coil block 242, the time stator for side 244 is magnetized to rotate the time rotor (A) 246. The time rotor (A) 246 is constituted to rotate by, for example, 180 degrees per second. The time rotor (A) 246 includes an upper shaft portion 246*a*, a lower shaft portion 246*b*, a pinion portion 246*c* and a rotor magnet 246*d*. The upper shaft portion 246*a* of the time rotor (A) 246 is rotatably integrated to a time rotor (A) upper bearing portion 106*a* provided at the train wheel bridge (A) 106. The lower shaft portion 246*b* of the time rotor (A) 246 is rotatably integrated to a time rotor (A) lower bearing portion 102*a* provided at the main plate 102. Therefore, the time rotor (A) 246 is rotatably arranged between the train wheel bridge (A) 106 and the main plate 102.

Based on rotation of the time rotor (A) 246, a second wheel & pinion for side 221 is constituted to rotate via rotation of a time fifth wheel & pinion for side, that is, a time fifth wheel & pinion (A) 220. The time fifth wheel & pinion (A) 220 includes an upper shaft portion 220*a*, a lower shaft portion 220*b*, a pinion portion 220*c* and a wheel portion 220*d*. The wheel portion 220*d* of the time fifth wheel & pinion (A) 220 is constituted to be brought in mesh with the pinion portion 246*c* of the time rotor (A) 246. The upper shaft portion 220*a* of the time fifth wheel & pinion (A) 220 is rotatably integrated to a time fifth wheel & pinion (A) upper bearing portion 106*b* provided at the train wheel bridge (A) 106. The lower shaft portion 220*b* of the time fifth wheel & pinion (A) 220 is rotatably integrated to a time fifth wheel & pinion (A) lower bearing portion 102*b* at the main plate 102. Therefore, the time fifth wheel & pinion (A) 220 is rotatably arranged between the train wheel bridge (A) 106 and the main plate 102.

The second wheel & pinion for side 221 includes an upper shaft portion 221*a* and, an abacus bead portion 221*b*, a pinion portion 221*c* and a wheel portion 221*d* disposed at the lower shaft portion. The wheel portion 221*d* of the second wheel & pinion fourth side 221 is constituted to be brought in mesh with the pinion portion 220*c* of the time fifth wheel & pinion (A) 220. The upper shaft portion 221*a* of the second wheel & pinion fourth side 221 is rotatably integrated to a side second wheel & pinion upper shaft portion 106*c* provided at the train wheel bridge (A) 106. The abacus bead portion 221*b* of the second wheel & pinion for side 221 is rotatably arranged to inside of the center hole of the cannon pinion for side 224*b*. Rotation center of the second wheel & pinion for side 221 is the main plate center 300. The second wheel & pinion for side 221 is constituted to rotate by one rotation per minute. The second hand 234 is attached to the second wheel & pinion for 221. The second hand 234 constitutes a second indicating member. As the second indicating member, the second hand may be used, a circular disk may be used or an indicating member of other shape including flower or geometrical shape may be used.

A side second wheel & pinion holder spring 231 is provided to exert press force to the second wheel & pinion for side 221.

Based on rotation of the second wheel & pinion for side 221, the center wheel & pinion for side 224 is constituted to rotate via rotation of a third wheel & pinion for side 222. The third wheel & pinion for side 222 includes an upper shaft portion, a lower shaft portion, a pinion portion 222*c* and a wheel portion 222*d*. The wheel portion 222*d* of the third wheel & pinion for side 222 is constituted to be brought in mesh with the pinion portion 221*c* of the second wheel & pinion for side 221. The upper shaft portion of the third wheel & pinion for side 222 is rotatably integrated to a side third wheel & pinion upper bearing portion 106*d* (refer to a view of the train wheel bridge (A) mentioned later) provided at the train wheel bridge (A) 106. The lower shaft portion of the third wheel & pinion for side 222 is rotatably integrated to a side third wheel & pinion lower bearing portion 102*d* (refer to a view of the main shaft, mentioned later) provided at the main plate 102. Therefore, the third wheel & pinion for side 222 is rotatably arranged between the train wheel bridge (A) 106 and the main plate 102. The center wheel &pinion for side 224 is constituted to rotate by one rotation per hour. The minute hand 232 is attached to the cannon pinion for side 224*b* of the center wheel & pinion for side 224. The minute hand 232 constitutes a minute indicating member. As a minute indicating member, the minute hand may be used, a circular disk may be used or an indicating member of other shape including flower or geometrical shape may be used.

Based on rotation of the center wheel & pinion for side 224, an hour wheel 228 is constituted to rotate via rotation of a minute wheel 226. The minute wheel 226 includes an upper shaft portion 226*a*, a lower shaft portion 226*b*, a pinion portion 226*c* and a wheel portion 226*d*. The wheel portion 226*d* of the minute wheel 226 is constituted to be brought in mesh with a pinion portion of the cannon pinion for side 224*b* of the second wheel & pinion for side 221. The upper shaft portion 226*a* of the minute wheel 226 is rotatably integrated to a minute wheel upper bearing portion 106*e* provided at the train wheel bridge (A) 106. The lower shaft portion 226*b* of the minute wheel 226 is rotatably integrated to a minute wheel lower bearing portion 102*e* provided at the main plate 102. The wheel portion 226*d* of the minute wheel 226 is rotatably arranged between the train wheel bridge (A) 106 and the main plate 102. The pinion portion 226*c* of the minute wheel 226 is rotatably arranged between the main plate 102 and the back train wheel bridge 108.

The hour wheel 228 is rotatably integrated to an outer peripheral portion of the center pipe 103. An hour wheel wheel portion 228*d* of the hour wheel 228 is rotatably arranged between the main plate 102 and the back train wheel bridge 108. Rotation center of the hour wheel 228 is the main plate center 300. Therefore, rotation center of the hour wheel 228 and rotation center of the center wheel & pinion for side 221 are disposed at a position the same as that of the rotation center of the center wheel & pinion for side 224. The hour wheel 228 is constituted to rotate by one rotation per 12 hours. The hour hand 234 is attached to the hour wheel 228. The hour hand 234 constitutes an hour indicating member. As the hour indicating member, the hour hand may be used, a circular disk may be used or an indicating member of other shape including flower or geometrical shape may be used.

When the hand setting stem 110 is rotated in the state of pulling out the hand setting stem 110 to the first stage, the clutch wheel 132 is rotated and the setting wheel 130 is constituted to be able to rotate by rotation of the clutch wheel 132. Further, time is constituted to be able to set by rotating the hour wheel 226 by the setting wheel 136. A reset lever 140 includes a reset conduction spring 140*d* and a train wheel setting portion 140*f*. In the state of pulling out the hand setting stem 110 to the first stage, the train wheel setting portion 140*f* of the reset lever 140 is constituted to be able to set rotation of the time wheel & pinion (A) 220. In the state of pulling out the hand setting stem 110 to the first stage, by conducting the reset conduction spring 140*d* to a reset pattern of the circuit block, the analog chronograph timepiece is constituted to be able to reset.

(1•3) Constitution of Chronograph Minute/Second Indicating Train Wheel Portion

Next, a constitution of a chronograph minute/second indicating train wheel portion operated by a chronograph measuring mode in the analog chronograph timepiece according to the invention will be explained. The chronograph minute/second indicating train wheel portion includes a motor for driving a chronograph minute/second indicating train wheel and the chronograph minute/second indicating train wheel.

In reference to FIG. 1, the chronograph minute/second indicating train wheel portion includes the motor for driving the chronograph minute/second indicating train wheel, that is, a chronograph minute/second motor and the chronograph minute/second indicating train wheel. The chronograph minute/second indicating train wheel is rotated by rotation of the chronograph minute/second motor, "chronograph minute" in elapse time measured in the chronograph measuring mode is constituted to indicate by a chronograph minute hand and "chronograph second" in the elapse time measured in the chronograph measuring mode is constituted to indicate by a chronograph second hand. In the chronograph measuring mode, IC (Integrated Circuit) 116 is constituted to measure the elapse time and operate the chronograph minute/second motor.

The chronograph minute/second motor includes a chronograph minute/second coil block 262, a chronograph minute/second stator 264 and a chronograph minute/second rotor 266. Dimensions and shape of the chronograph minute/second coil block 262 can be made the same as dimensions and shape of the time coil block for side 242. Dimensions and shape of the chronograph minute/second stator 264 can be made the same as dimensions and shape of the time stator for side 244.

When a chronograph minute/second motor drive signal outputted by IC (Integrated Circuit) 116 is inputted to the chronograph minute/second coil block 262, the chronograph minute/second stator 264 is magnetized to rotate the chronograph minute/second rotor 266. The chronograph minute/second rotor 266 is constituted to rotate by, for example, 180 degrees per second. The chronograph minute/second rotor 266 includes an upper shaft portion, a lower shaft portion, a pinion portion and a rotor magnet. The upper shaft portion of the chronograph minute/second rotor 266 is rotatably integrated to a chronograph minute/second rotor upper bearing portion 107*f* (refer to a view of the train wheel bridge (B) 107, mentioned later) provided at the train wheel bridge (B) 107. The lower shaft portion of the chronograph minute/second rotor 266 is rotatably integrated to a chronograph minute/second rotor lower bearing portion 102*f* (refer to a view of the main plate, mentioned later) provided at the main plate 102. Therefore, the chronograph minute/second rotor 266 is arranged rotatably between the train wheel bridge (B) 107 and the main plate 102.

Based on rotation of the chronograph minute/second rotor 266, a chronograph minute/second fifth wheel & pinion 250 is constituted to rotate. Based on rotation of the chronograph minute/second fifth wheel & pinion 250, a second-counter intermediate wheel (A) 251 and a minute-counter intermediate wheel (A) 252 are constituted to rotate. The chronograph minute/second fifth wheel & pinion 250 includes an upper shaft portion, a lower shaft portion, a pinion portion and a wheel portion. The wheel portion of the chronograph minute/second fifth wheel & pinion 250 is constituted to be brought in mesh with the pinion portion of the chronograph minute/second rotor 266. The upper shaft portion of the chronograph minute/second fifth wheel & pinion 250 is rotatably integrated to a chronograph minute/second fifth wheel & pinion upper bearing portion 106*g* (refer to a view of the train wheel bridge (B) 107, mentioned later) provided at the train wheel bridge (B) 107. The lower shaft portion of the chronograph minute/second fifth wheel & pinion 250 is rotatably integrated to a chronograph minute/second fifth wheel & pinion lower bearing portion 102*g* (refer to a view of the main plate, mentioned later) provided at the main plate 102. Therefore, the chronograph minute-second fifth wheel & pinion 250 is rotatably arranged between the train wheel bridge (B) 107 and the main plate 102.

Based on rotation of the second-counter intermediate wheel (A) 251, a second-counting wheel 254 is constituted to rotate via rotation of a second-counter intermediate wheel (B) 253. Dimensions and shape of the second-counter intermediate wheel (A) 251 are constituted to be the same as dimensions and shape of the second-counter intermediate wheel (B) 253. The second-counter intermediate wheel (A) 251 includes an upper shaft portion, a lower shaft portion and a wheel portion. The wheel portion of the second-counter intermediate wheel (A) 251 is constituted to be brought in mesh with a pinion portion of the chronograph minute/second fifth wheel & pinion 250. The upper shaft portion of the second-counter intermediate wheel (A) 251 is rotatably integrated to a second-counter intermediate wheel (A) upper bearing portion 108*h* (refer to a view of the back train wheel bridge, mentioned later) provided at the back train wheel bridge 108. The lower shaft portion of the second-counter intermediate wheel (A) 251 is rotatably integrated to a second-counter intermediate wheel (A) lower bearing portion 102*h* (refer to a view of the main plate, mentioned later) provided at the main plate 102. Therefore, the second-counter intermediate wheel (A) 251 is rotatably arranged between the back train wheel bridge 108 and the main plate 102.

The second-counter intermediate wheel (B) 253 includes an upper shaft portion, a lower shaft portion and a wheel portion. The wheel portion of the second-counter intermediate wheel (B) 253 is constituted to be brought in mesh with the wheel portion of the second-counter intermediate wheel (A) 251. The upper shaft portion of the second-counter intermediate wheel (B) 253 is rotatably integrated to a second-counter intermediate wheel (B) upper bearing portion 108*j* (refer to a view of the back train wheel bridge, mentioned later) provided at the back train wheel bridge 108. The lower shaft portion of the second-counter intermediate wheel (B) 253 is rotatably integrated to a second-counter intermediate wheel (B) lower bearing portion 102*j* (refer to a view of the main plate, mentioned later) provided at the main plate 102. Therefore, the second-counter intermediate wheel (B) 253 is rotatably arranged between the back train wheel bridge 108 and the main plate 102.

The second-counting wheel 254 includes an upper shaft portion, a lower shaft portion and a wheel portion. The wheel portion of the second-counting wheel 254 is constituted to be brought in mesh with the wheel portion of the second-counter intermediate wheel (B) 253. The upper shaft portion of the second-counting wheel 254 is rotatably integrated to a second-counting wheel upper bearing portion 108*k* (refer to a view of the back train wheel bridge, mentioned later) provided at the back train wheel bridge 108. The lower shaft portion of the second-counting wheel 254 is rotatably integrated to a second-counting wheel lower bearing portion 102*k* (refer to a view of the main plate, mentioned later) provided at the main plate 102. Therefore, the second-counting wheel 254 is arranged rotatably between the back train wheel bridge 108 and the main plate 102. A second chronograph hand 255 (refer to a view of a complete, mentioned later) is attached to the second-counting wheel 254. The second chronograph hand 255 constitutes a second chronograph indicating member. In the chronograph measuring mode, the second chronograph hand 255 is operated to indicate "second" in elapse time.

In reference to FIG. 1, rotation center of the second-counting wheel 254 is disposed at a position above the main plate reference horizontal axis line 304 and between the main plate center 300 and an outer shape portion 306 of the main plate 102 disposed in "6 o'clock direction" of the movement 100. A distance between rotation center of the second-counting wheel 254 and the main plate center 300 is about ½ of a radius of a maximum outer shape portion of the main plate 102.

Based on rotation of the minute-counter intermediate wheel (A) 252, a minute-counting wheel 258 is constituted to rotate via rotation of a minute-counter intermediate wheel (B) 257. The minute-counter intermediate wheel (A) 252 includes an upper shaft portion, a lower shaft portion a pinion portion and a wheel portion. The wheel portion of the minute-counter intermediate wheel (A) 252 is constituted to be brought in mesh with the pinion portion of the chronograph minute/second fifth wheel & pinion 250. The upper shaft portion of the minute-counter intermediate wheel (A)

252 is rotatably integrated to a minute-counter intermediate wheel (A) upper bearing portion 108*m* (refer to a view of the back train wheel bridge, mentioned later) provided at the back train wheel bridge 108. The lower shaft portion of the minute-counter intermediate wheel (A) 252 is rotatably integrated to a minute-counter intermediate wheel (A) lower bearing portion 102*m* (refer to a view of the main plate, mentioned later) provided at the main plate 102. Therefore, the minute-counter intermediate wheel (A) 252 is rotatably arranged between the back train wheel bridge 108 and the main plate 102.

The minute-counter intermediate wheel (B) 257 includes an upper shaft portion, a lower shaft portion, a pinion portion and a wheel portion. The minute-counter intermediate wheel (B) 257 is constituted to be brought in mesh with a pinion portion of the minute-counter intermediate wheel (A) 252. The upper shaft portion of the minute-counter intermediate wheel (B) 257 is rotatably integrated to a minute-counter intermediate wheel (B) upper bearing portion 108*n* (refer to a view of the back train wheel bridge, mentioned later) provided at the back train wheel bridge 108. The lower shaft portion of the minute-counter intermediate wheel (B) 257 is rotatably integrated to a minute-counter intermediate wheel (B) lower bearing portion 102*n* (refer to a view of the main plate, mentioned later) provided at the main plate 102. Therefore, the minute-counter intermediate wheel (B) 257 is rotatably arranged between the back train wheel bridge 108 and the main plate 102.

The minute-counting wheel 258 includes an upper shaft portion, a lower shaft portion and a wheel portion. The wheel portion of the minute-counting wheel 258 is constituted to be brought in mesh with the wheel portion of the minute-counter intermediate wheel (B) 257. The upper shaft portion of the minute-counting wheel 258 is rotatably integrated to a minute-counting wheel upper bearing portion 108*p* (refer to a view of the back train wheel bridge, mentioned later) provided at the back train wheel bridge 108. The lower shaft portion of the minute-counting wheel 258 is rotatably integrated to a minute-counting wheel lower bearing portion 102*p* (refer to a view of the main plate, mentioned later) provided at the main plate 102. Therefore, the minute-counting wheel 258 is rotatably arranged between the back train wheel bridge 108 and the main plate 102. A minute chronograph hand 259 (refer to a view of a complete, mentioned later) is attached to the minute-counting wheel 258. The minute chronograph hand 259 constitutes a minute chronograph indicating member. In the chronograph measuring mode, the minute chronograph hand 259 is operated to indicate "minute" of elapse time.

In reference to FIG. 1, rotation center of the minute-counting wheel 258 is disposed above the main plate reference vertical axis line 302 and between the main plate center 300 and an outer shape portion 309 of the main plate 102 in "9 o'clock direction" of the movement 100. A distance between rotation center of the minute-counting wheel 258 and the main plate center 300 is about ½ of a radius of a maximum outer shape portion of the main plate 102.

(1•4) Constitution of 1/10 Second Indicating Train Wheel Portion

Next, an explanation will be given of a constitution of a 1/10 second indicating train wheel portion operated in the chronograph measuring mode in the analog electronic timepiece according to the invention. The 1/10 second indicating train wheel portion includes a motor for driving a 1/10 second indicating train wheel and the 1/10 second indicating train wheel.

In reference to FIG. 1 through FIG. 3, the 1/10 second motor includes a 1/10 second coil block 282, a 1/10 second stator 284 and a 1/10 second rotor 286. Dimensions and shape of the 1/10 second coil block 282 can be made the same as the dimensions and shape of the time coil block for side 242. Dimensions and shape of the 1/10 second stator 284 can be made the same as dimensions and shape of the time stator for side 244.

When a 1/10 second motor drive signal outputted by IC (Integrated Circuit) 116 is inputted to the 1/10 second coil block 282, the 1/10 second stator 284 is magnetized to rotate the 1/10 second rotor 286. The 1/10 second rotor 286 is constituted to rotate by, for example, 180 degrees per 1/10 second. The 1/10 second rotor 286 includes an upper shaft portion 286*a*, a lower shaft portion 286*b*, a pinion portion 286*c* and a rotor magnet 286*d*. The upper shaft portion 286*a* of the 1/10 second rotor 286 is rotatably integrated to a 1/10 second rotor upper bearing portion 106*r* provided at the train wheel bridge (A) 106. The lower shaft portion 286*b* of the 1/10 second rotor 286 is rotatably integrated to a 1/10 second rotor lower bearing portion 102*r* provided at the main plate 102. Therefore, the 1/10 second rotor 286 is rotatably arranged between the train wheel bridge (A) 106 and the main plate 102.

The time rotor (A) 246, the chronograph minute/second rotor 266 and the 1/10 rotor 286 are the same part. However, although the time rotor (A) 246 and the chronograph minute/second rotor 266 are integrated by disposing the pinion portions on an upper side (integrated such that the pinion portions are proximate to the train wheel bridge (A) 106), the 1/10 second rotor 286 is integrated by disposing the pinion portion on a lower side (integrated such that the pinion portion is proximate to the main plate 102).

A 1/10 second fifth wheel & pinion 270 is constituted to rotate based on rotation of the 1/10 second rotor 286. The 1/10 second fifth wheel & pinion 270 includes an upper shaft portion 270*a*, a lower shaft portion 270*b*, an upper pinion portion 270*c*, a wheel portion 270*d* and a lower pinion portion 270*f*. The wheel portion 270*d* of the 1/10 second fifth wheel & pinion 270 is constituted to be brought in mesh with the pinion portion 286*c* of the 1/10 second rotor 286. The upper shaft portion 270*a* of the 1/10 second fifth wheel & pinion 270 is rotatably integrated to a 1/10 second fifth wheel & pinion upper bearing portion 106*s* provided at the train wheel bridge (A) 106. The lower shaft portion 270*b* of the 1/10 second fifth wheel & pinion 270 is rotatably integrated to a 1/10 second fifth wheel & pinion lower bearing portion 102*s* provided at the main plate 102. Therefore, the 1/10 second fifth wheel & pinion 270 is rotatably arranged between the train wheel bridge (A) 106 and the main plate 102.

A 1/10 second-counter intermediate wheel (B) 272 is constituted to rotate based on rotation of the 1/10 second fifth wheel & pinion 270 via rotation of a 1/10 second-counter intermediate wheel (A) 271. Dimensions and shape of the 1/10 second-counter intermediate wheel (A) 271 are constituted to be the same as dimensions and shape of the 1/10 second-counter intermediate wheel (B) 272. The 1/10 second-counter intermediate wheel (A) 271 includes an upper shaft portion 271*a*, a lower shaft portion 271*b* and a wheel portion 271*d*. The wheel portion 271*d* of the 1/10 second-counter intermediate wheel (A) 271 is constituted to be brought in mesh with the lower pinion portion 270*f* of the 1/10 second fifth wheel & pinion 270. The upper shaft portion 271*a* of the 1/10 second-counter intermediate wheel (A) 271 is rotatably integrated to a 1/10 second-counter intermediate wheel (A) upper bearing portion 108*t* provided at the back train wheel bridge 108. The lower shaft portion 271*b* of the 1/10 second-counter intermediate wheel (A) 271 is rotatably integrated to a 1/10 second-counter intermediate wheel (A) lower bearing portion 102*t* provided at the main plate 102. Therefore, the 1/10 second-counter intermediate wheel (A) 271 is rotatably arranged between the back train wheel bridge 108 and the main plate 102.

The 1/10 second-counter intermediate wheel (B) 272 includes an upper shaft portion 272*a*, a lower shaft portion 272*b* and a wheel portion 272*d*. The wheel portion 272*d* of the 1/10-counter intermediate wheel (B) 272 is constituted to be brought in mesh with the wheel portion 271*d* of the 1/10 second-counter intermediate wheel (A) 271. The upper shaft portion 272*a* of the 1/10 second-counter intermediate wheel (B) 272 is rotatably integrated to a 1/10 second-counter intermediate wheel (B) upper bearing portion 108*u* (refer to a view of the back train wheel bridge, mentioned later) provided at the back train wheel bridge 108. The lower shaft portion 272*b* of the 1/10 second-counter intermediate wheel (B) 272 is rotatably integrated to a 1/10 second-counter intermediate wheel (B) lower bearing portion 102*u* (refer to a view of the main plate, mentioned later) provided at the main plate portion 102. Therefore, the 1/10 second-counter intermediate wheel (B) 272 is rotatably arranged between the back train wheel bridge 108 and the main plate 102.

A 1/10 second-counting wheel 274 is constituted to rotate based on rotation of the 1/10 second-counter intermediate wheel (B) 272. The 1/10 second-counting wheel 274 includes an upper shaft portion 274*a*, a lower shaft portion 274*b* and a wheel portion 274*d*. The wheel portion 274*d* of the 1/10 second counting wheel 254 is constituted to be brought in mesh with the wheel portion 272*d* of the 1/10 second-counter intermediate wheel (B) 272. The upper shaft portion 274*a* of the 1/10 second-counting wheel 274 is rotatably integrated to a 1/10 second-counting wheel upper bearing portion 108*v* (refer to a view of the back train wheel bridge, mentioned below) provided at the back train wheel bridge 108. The lower shaft portion 274*b* of the 1/10 second-counting wheel 274 is rotatably integrated to a 1/10 second-counting wheel lower bearing portion 102*v* (refer to a view of the main plate, mentioned later) provided at the main plate 102. Therefore, the 1/10 second-counting wheel 274 is rotatably arranged between the back train wheel bridge 108 and the main plate 102. A 1/10 second chronograph hand 275 is attached to the 1/10 second-counting wheel 274. The 1/10 second chronograph hand 275 constitutes a 1/10 second-counting indicating member. In the chronograph measuring mode, the 1/10 second chronograph hand 275 is operated to indicate "1/10 second" in elapse time.

In reference to FIG. 1, rotation center of the 1/10 second-counting wheel 274 is disposed at a position above the main plate reference horizontal axis line 304 and between the main plate center 300 and an outer shape portion 312 of the main plate 102 disposed in "12 o'clock direction" of the movement 100. A distance between the rotation center of the 1/10 second-counting wheel 274 and the main plate center 300 is about 1/2 of a radius of a maximum outer shape portion of the main plate 102.

(1•5) Constitution of Main Plate

Figure 4:
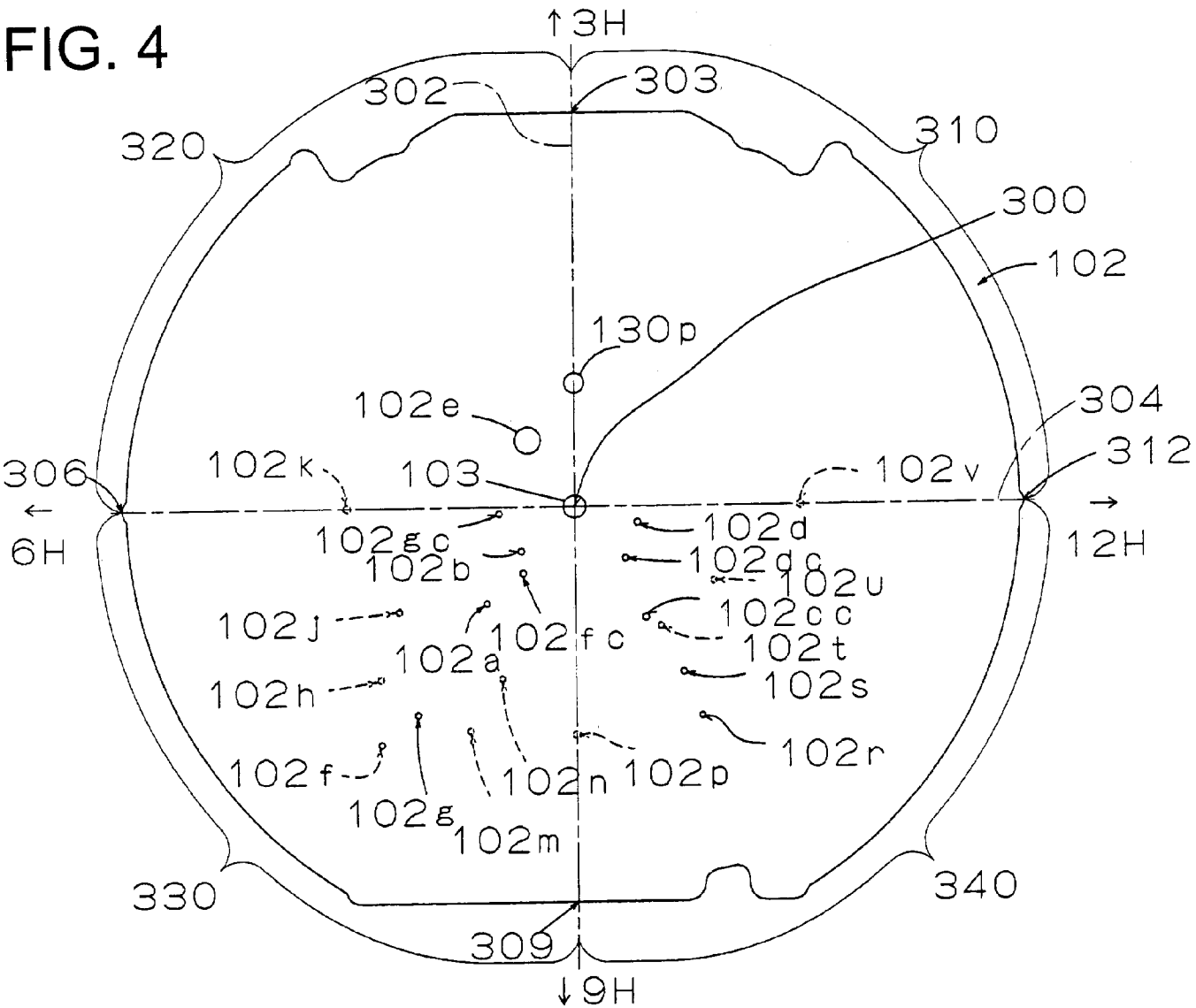
FIG. 4 is a plane view showing an outline shape by viewing a main plate from a surface side according to the embodiment of the chronograph timepiece of the invention (in FIG. 4, illustration of a shape of a portion of the main plate is omitted)

In reference to FIG. 1 and FIG. 4, at the main plate 102, the main plate center 300 is arranged with the center pipe 103. A rotation center shaft 130P of the setting wheel 130 is disposed at a position above the main plate reference vertical axis line 302 and between the main plate center 300 and an outer shape portion 303 of the main plate 102 disposed in "3 o'clock direction" of the movement 100. A minute wheel lower bearing portion 102*e* is arranged at the second region 320 in the main plate 102. Rotation center of the setting lever 134, rotation center of the yoke 136 and rotation center of the reset lever 140 are arranged at the second region 320 in the main plate 102.

The-second-counting wheel lower bearing portion 102*k* is disposed at a position above the main plate reference horizontal axis line 304 and between the main plate center 300 and the outer shape portion 306 of the main plate 102 disposed in "6 o'clock direction" of the movement 100.

The time rotor (A) lower bearing portion 102*a* and the time fifth wheel & pinion (A) lower bearing portion 102V are arranged at the third region 330 in the main plate 102.

The chronograph minute/second rotor lower bearing portion 102*f*, the chronograph minute/second fifth wheel & pinion lower bearing portion 102*g*, the second-counter intermediate wheel (A) lower bearing portion 102*h*, the second-counter intermediate wheel (B) lower bearing portion 102*j*, the minute-counter intermediate wheel (A) lower bearing portion 102*m* and the minute-counter intermediate wheel (B) lower bearing portion 102*n* are arranged at the third region 330 in the main plate 102.

The minute-counting wheel lower bearing portion 102*p* is disposed at a position above the main plate reference vertical axis line 302 and between the main plate center 300 and the outer shape portion 309 of the main plate 102 disposed in "9 o'clock direction" of the movement 100.

The side third wheel & pinion lower bearing portion 102*d* is arranged at the fourth region 340 in the main plate 102.

The 1/10 second rotor lower bearing portion 102*r*, the 1/10 second fifth wheel & pinion lower bearing portion 102*s*, the 1/10 second-counter intermediate wheel (A) lower bearing portion 102*t* and the 1/10 second-counter intermediate wheel (B) lower bearing portion 102*u* are arranged at the fourth region 340 in the main plate 102.

The 1/10 second-counting wheel lower bearing portion 102*v* is disposed at a position above the main plate reference horizontal axis line 304 and between the main plate center 300 and the outer shape portion 312 of the main plate 102 disposed in "12 o'clock direction" of the movement 100.

(1•6) Constitutions of Train Wheel Bridge (A) and Train Wheel Bridge (B)

Figure 5:
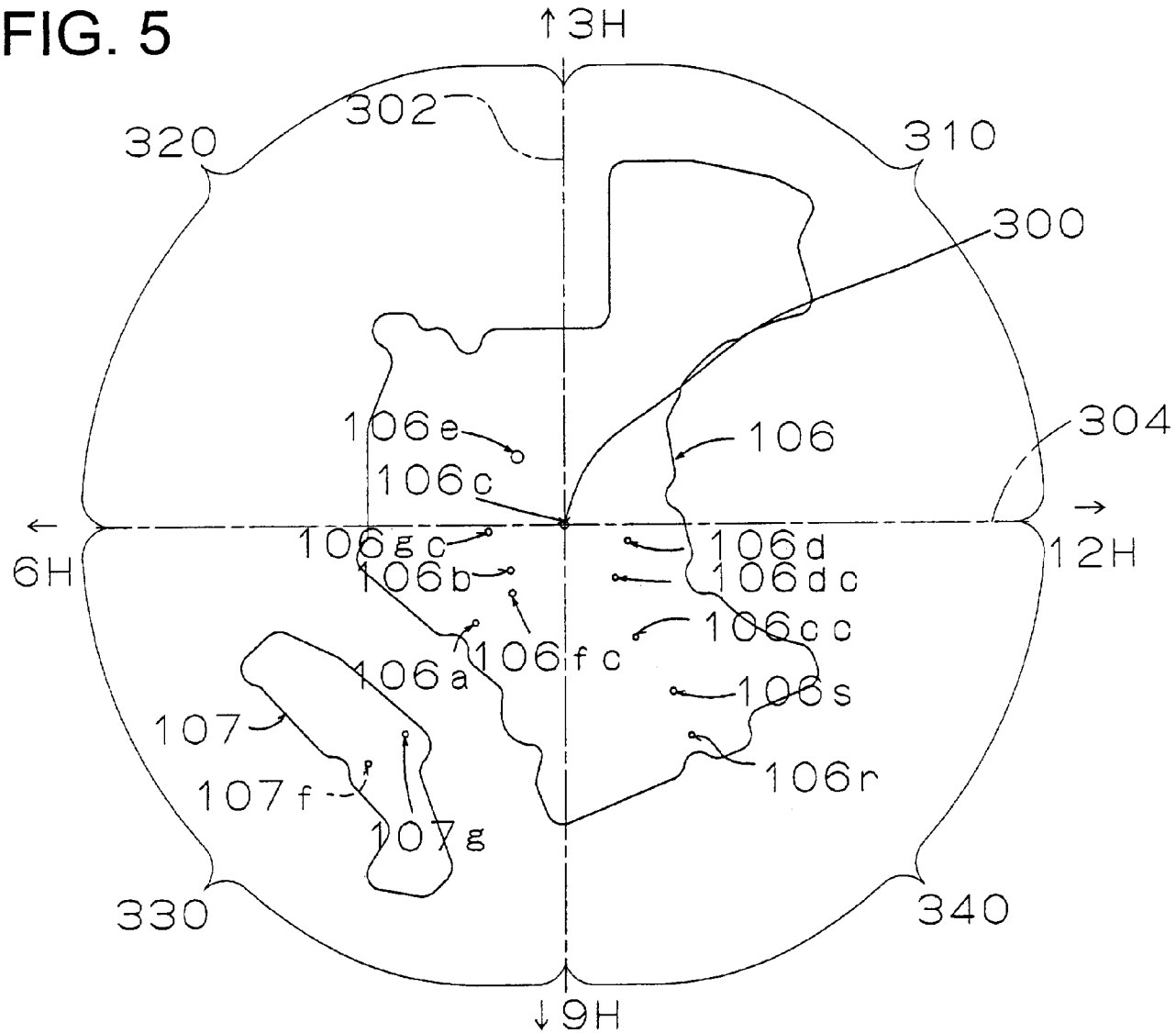
FIG. 5 is a plane view showing an outline shape by viewing a train wheel bridge (A) and a train wheel bridge (B) from a surface side according to the embodiment of the chronograph timepiece of the invention (in FIG. 5, illustration of shapes of portions of the train wheel bridge (A) and the train wheel bridge (B) are omitted)

In reference to FIG. 1 and FIG. 5, in the train wheel bridge (A) 106, the side second wheel & pinion upper bearing portion 106*c* is arranged at the main plate center 300. The minute wheel upper bearing portion 106*e* is arranged at the second region 320 in the train wheel bridge (A) 106.

The time rotor (A) upper bearing portion 106*a* and the time fifth wheel & pinion (A) upper bearing portion 106*b* are arranged at the third region 330 in the train wheel bridge (A) 106.

The chronograph minute/second rotor upper bearing portion 107*f* and the chronograph minute/second fifth wheel & pinion upper bearing portion 107*g* are arranged at the third region 330 in the train wheel bridge (B) 107.

The side third wheel & pinion upper bearing portion 106*d* is arranged at the fourth region 340 in the train wheel bridge (A) 106.

The 1/10 second rotor upper bearing portion 106*r* and the 1/10 second fifth wheel & pinion upper bearing portion 106*s* are arranged at the fourth region 340 in the train wheel bridge (A) 106.

(1•7) Constitution of Back Train Wheel Bridge

Figure 6:
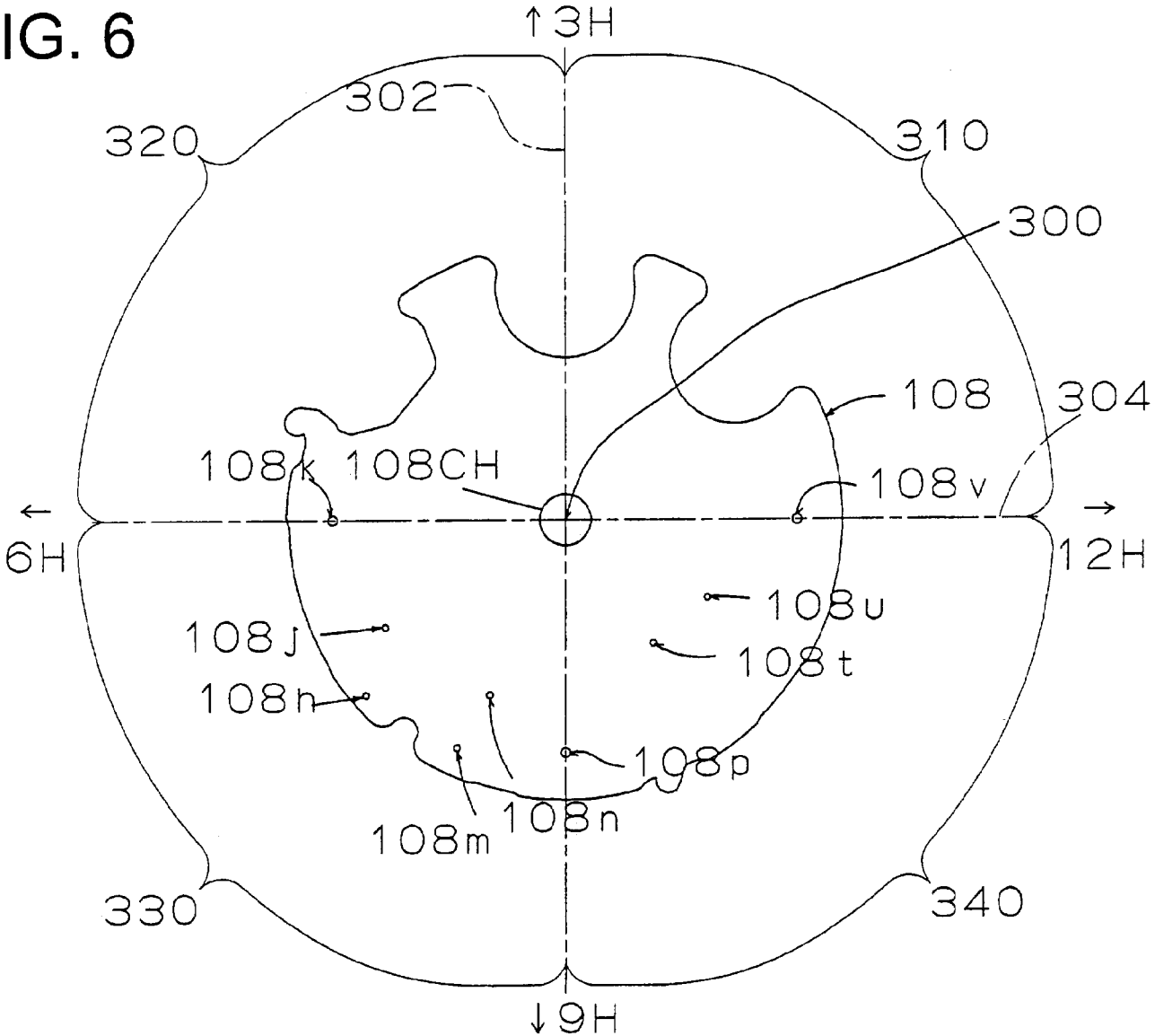
FIG. 6 is a plane view showing an outline shape by viewing a back train wheel bridge from a back side (a side of the main plate) according to the embodiment of the chronograph timepiece of the invention (in FIG. 6, illustration of a shape of a portion of the back train wheel bridge is omitted)
Figure 7:
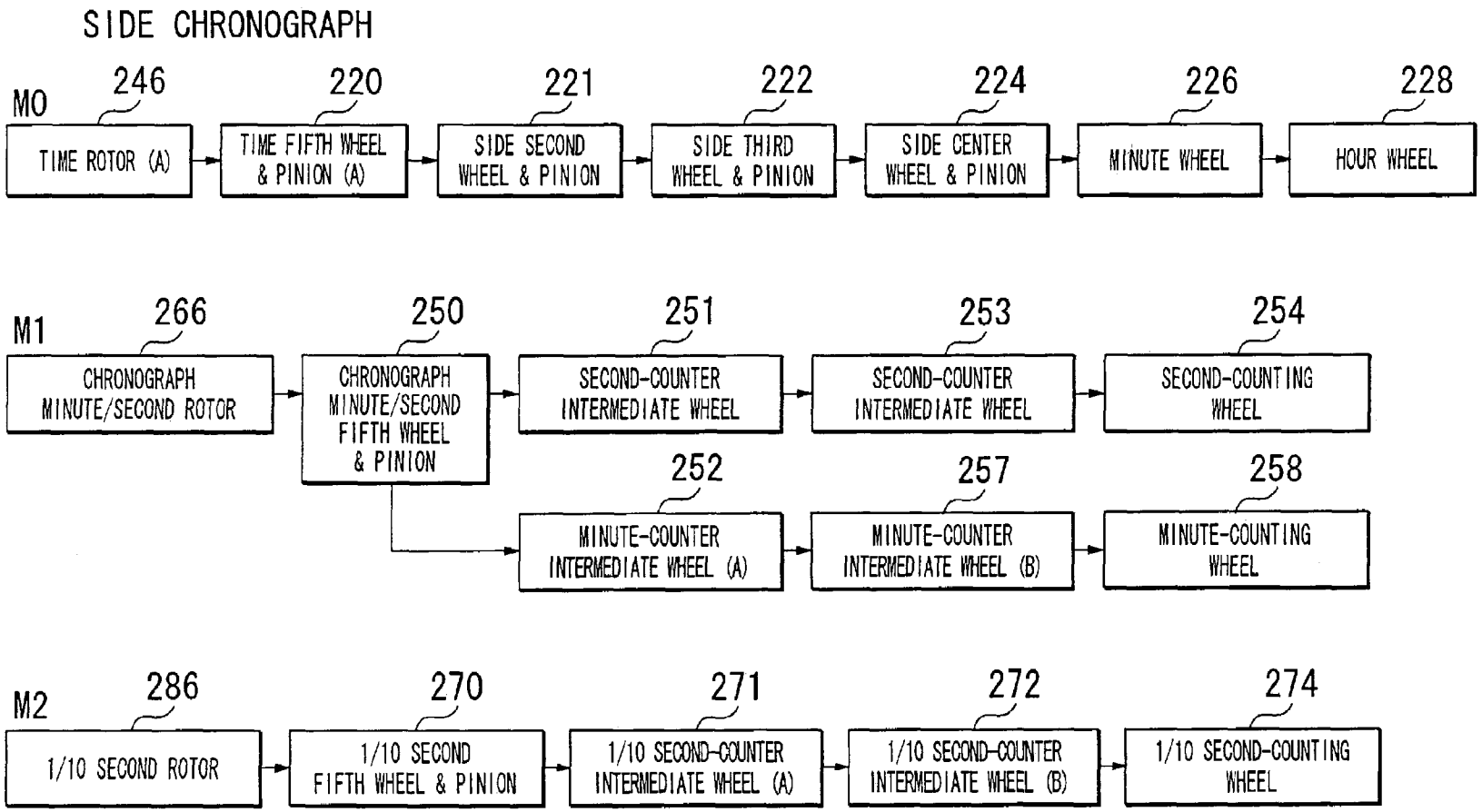
FIG. 7 is a block diagram of the motor and the train wheel bridge of the movement of the side chronograph timepiece according to the embodiment of the chronograph timepiece of the invention.

In reference to FIG. 1 and FIG. 6, in the back train wheel bridge 108, a center hole 108CH is provided at the main plate center 300.

The second-counting wheel upper bearing portion 108*k* is disposed at a position in the back train wheel 108, above the main plate reference horizontal axis line 304 and between the main plate center 300 and an outer shape portion of the back train wheel bridge 108 disposed in "6 o'clock direction" of the movement 100.

The second-counter intermediate wheel (A) upper bearing portion 108*h*, the second-counter intermediate wheel (B) upper bearing portion 108*j*, the minute-counter intermediate wheel (A) upper bearing portion 108*m* and the minute-counter intermediate wheel (B) upper bearing portion 108*n* are arranged at the third region 330 in the back train wheel bridge 108.

The minute-counting wheel upper bearing portion 108*p* is disposed at a position in the back train wheel bridge 108, above the main plate reference vertical axis line 302 and between the main plate center 300 and an outer shape portion of the back train wheel bridge 108 disposed in "9 o'clock direction" of the movement 100.

The 1/10 second-counter intermediate wheel (A) upper bearing portion 108*t* and the 1/10 second-counter intermediate wheel (B) upper bearing portion 108*u* are arranged at the fourth region 304 in the back train wheel bridge 108.

The 1/10 second-counting wheel upper bearing portion 108*v* is disposed at a position in the back train wheel bridge 108, above the main plate reference horizontal axis line 304 and between the main plate center 300 and an outer shape portion of the back train wheel bridge 108 disposed in "12 o'clock direction" of the movement 100.

(1•8) Arrangement of Parts in Movement

Next, a preferable arrangement of parts in the movement 100 will be explained.

In reference to FIG. 1, on the surface side of the movement 100, a rotation center 134*c* of the setting lever 134, a rotation center 136*c* of the yoke 136 and a rotation center 140*c* of the reset lever 140 are arranged at the second region 320. The yoke 136 is preferably fabricated by an elastically deformable material, for example, stainless steel. A spring portion of the yoke 136 is disposed in the second region 320 on the surface side of the movement 100. By constituting in this way, a long spring can effectively arranged on the surface side of the movement.

The crystal unit 114 and IC (Integrated Circuit) 116 are arranged at the second region 320 on the surface side of the movement 100. By constituting in this way, the crystal unit 114 and IC (Integrated Circuit) 116 can effectively be arranged on the surface side of the movement. As a modified example, the crystal unit 114 may be arranged at the first region 310 on the surface side of the movement 100. As a modified example, IC (Integrated Circuit) 116 may be arranged at the first region 310 on the surface side of the movement 100.

A position of the reset lever 140 for setting the time fifth wheel & pinion (A) 220 is arranged at the third region 330 on the surface side of the movement 100. A position of the reset lever 140 for carrying out resetting operation is arranged at the second region 320 on the surface side of the movement 100. By constituting in this way, the reset lever 140 having a long spring portion can effectively be arranged on the surface side of the movement.

The center of the battery 120 may be arranged at the first region 310 on the surface side of the movement 100. However, the center of the battery 120 may be disposed at the fourth region 340 on the surface side of the movement 100. That is, although the center of the battery 120 may be disposed at the first region 310 or may be disposed at the fourth region 340, the battery 120 is arranged to overlap the main plate reference horizontal axis line 312 between the first region 310 and the fourth region 340. By constituting in this way, the battery 120 having a large size can effectively be arranged on the surface side of the movement 100.

A center (hereinafter, referred to as "coil block center") 242*c* of a center axis line in a length direction of a coil wire winding portion of the time coil block for side 242 may be arranged at the third region 330. Rotation center of the time rotor (A) 246 and rotation center of the time fifth wheel & pinion (A) 220 maybe arranged at the third region 330. Rotation center of the third wheel & pinion for side 222 may be arranged at the fourth region 340. Rotation center of the minute wheel 226 may be arranged at the second region 320.

A coil block center 262*c* of the chronograph minute/second coil block 262 maybe arranged at the third region 330. Rotation center of the chronograph minute/second rotor 266, rotation center of the chronograph minute/second fifth wheel & pinion 250, rotation center of the second-counter intermediate wheel (A) 251, rotation center of the minute-counter intermediate wheel (A) 252, rotation center of the second-counter intermediate wheel (B) 253 and rotation center of the minute-counter intermediate wheel (B) 257 may be arranged at the third region 330. In the third region 330, the coil block center 262*c* of the chronograph minute/second coil block 262 is arranged on an outer side of the coil block center 242*c* of the time coil block for side 242. In the third region 330, rotation center of the chronograph minute/second rotor 266 is arranged on an outer side of rotation center of the time rotor (A) 246.

The rotation center of the second-counting wheel 254 is disposed at a position above the main plate reference horizontal axis line 304 and between the main plate center 300 and the outer shape portion 306 of the main plate 102 disposed in "6 o'clock direction" of the movement 100. The distance between rotation center of the second-counting wheel 254 and the main plate center 300 is preferably 30% through 70% of the radius of the maximum outer shape portion of the main plate 102, more preferably 45% through 55% of the radius of the maximum outer shape portion of the main plate 102 and particularly preferably about ½ of the radius of the maximum outer shape portion of the main plate 102.

Further, rotation center of the minute-counting wheel 258 is disposed at a position above the main plate reference vertical axis line 302 and between the main plate center 300 and the outer shape portion 309 of the main plate 102 disposed in "9 o'clock direction" of the movement 100. The distance between rotation center of the minute-counting wheel 258 and the main plate center 300 is preferably 30% through 70% of the radius of the maximum outer shape portion of the main plate 102, more preferably 45% through 55% of the radius of the maximum outer shape portion of the main plate 102 and particularly preferably about ½ of the radius of the maximum outer shape portion of the main plate 102.

A coil block center 282*c* of the 1/10 second coil block 282 may be arranged at the fourth region 340. Rotation center of the 1/10 second rotor 286, rotation center of the 1/10 second fifth wheel & pinion 270, rotation center of the 1/10 second-counter intermediate wheel (A) 271 and rotation center of the 1/10 second-counter intermediate wheel (B) 272 may be arranged at the fourth region 340. By constituting in this way, the plurality of coil blocks and the plurality of train wheels can effectively be arranged on the surface side of the movement. Here, a number of parts constituting the train wheels is not restricted to the above-described but one or more of transmission wheels can further be added.

Rotation center of the 1/10 second-counting wheel 274 is disposed at a position above the main plate reference horizontal axis line 304 and between the main plate center 300 and the outer shape portion 312 of the main plate 102 disposed in "12 o'clock direction" of the movement 100. The distance between rotation center of the 1/10 second-counting wheel 274 and the main plate center 300 is preferably 30% through 70% of the radius of the maximum outer shape portion of the main plate 102, more preferably, 45% through 55% of the radius of the maximum outer shape portion of the main plate 102 and particularly preferably about ½ of the radius of the maximum outer shape portion of the main plate 102.

It is preferable that the distance between rotation center of the second-counting wheel 254 and the main plate center 300, the distance between rotation center of the minute-counting wheel 258 and the main plate center 300 and the distance between rotation center of the 1/10 second-counting wheel 274 and the main plate center 300 are all constituted to be an equal value.

(1•9) Operation of First Embodiment

Next, an explanation will be given of operation of the first embodiment of the analog electronic timepiece according to the invention.

Figure 8:
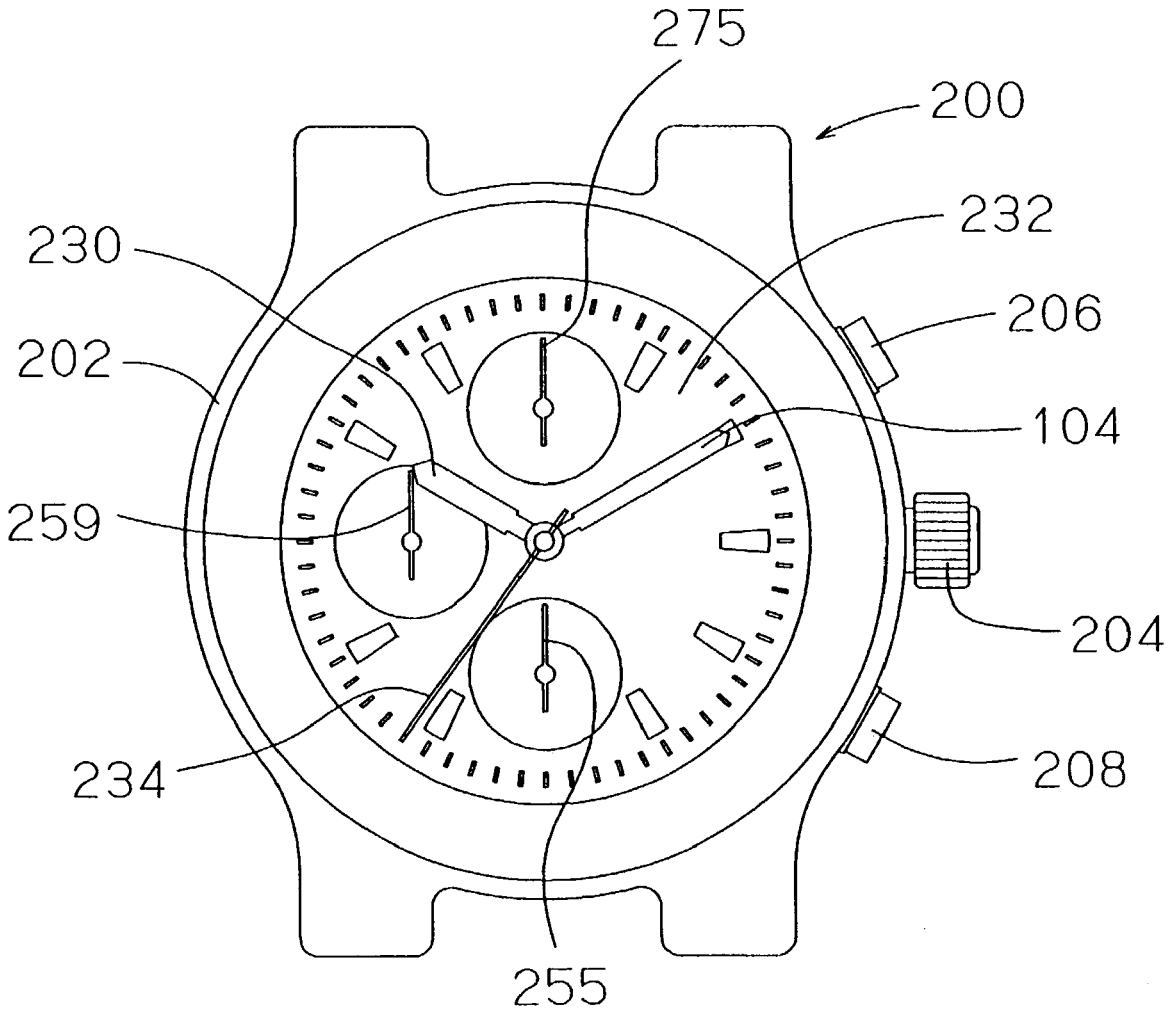
FIG. 8 is a plane view showing an outline shape of a complete of the side chronograph timepiece according to the embodiment of the chronograph timepiece of the invention.

In reference to FIG. 8, a complete 200 of the side chronograph timepiece is provided with an outer case 202. The movement 100 and the dial 104 are contained in the outer case 202. A crown 204 is provided to the outer case 202 to rotate integrally with the hand setting stem 110. Time of the side chronograph time piece is constituted to be able to set by pulling out the crown 204 to the first stage and rotating the crown 204. That is, in a state of pulling out the crown 204 to the first stage to pull out the hand setting stem 110 to the first stage, the train wheel setting portion 140*f* of the reset lever 140 sets rotation of the time fifth wheel & pinion (A) 220 and the reset conduction spring 140*d* is conducted to the reset pattern of the circuit block to thereby reset the analog chronograph timepiece. Further, in the state of pulling out the crown 209 to the first stage to pull out the hand setting stem 110 to the first stage, the second hand 234 is stopped and by rotating the crown 204, the hour hand 230 and the minute hand 232 can be rotated.

The outer case 202 is provided with a start/stop button 206 for starting and stopping operation of chronograph of the side chronograph timepiece. When the start/stop button 206 is pushed, the switch spring is constituted to operate to transmit a signal with regard to starting operation or stopping operation of the chronograph to IC 116. The outer case 202 is provided with a reset button 208 for resetting the operation of the chronograph of the side chronograph timepiece. When the reset button 208 is pushed, the switch spring is constituted to operate to transmit a signal with regard to resetting operation of the chronograph to IC 116.

Here, operation of indicating current time will be explained. In reference to FIG. 1 through FIG. 3, FIG. 7 and FIG. 8, time of the side chronograph timepiece is set to current time by pulling out the crown 204 to the first stage and rotating the crown 204 and the crown 204 is pushed to the 0 stage. Under the state, the time rotor (A) 246 is rotated and the second wheel & pinion for side 221 is rotated based on rotation of the time rotor (A) 246 via rotation of the time fifth wheel & pinion (A) 220. The second wheel & pinion for side 221 is rotated by one rotation per minute and therefore, the second hand 234 attached to the second wheel & pinion for side 221 indicates "second" in current time.

Further, the center wheel &pinion for side 224 is rotated based on rotation of the second wheel & pinion for side 221 via rotation of the third wheel & pinion for side 222. The center wheel & pinion for side 224 is rotated by one rotation per hour and therefore, the minute hand 232 attached to the cannon pinion for side 224*b* of the center wheel & pinion for side 224 indicates "minute" of current time.

Further, the hour wheel 228 is rotated based on rotation of the center wheel & pinion for side 224 via rotation of the minute wheel 226. The hour wheel 228 rotates by one rotation per 12 hours and therefore, the hour hand 234 attached to the hour wheel 228 indicates "hour" of current time.

Next, operation of measuring the chronograph will be explained. In reference to FIG. 8, in a state in which the chronograph stops measuring and is reset, all of the minute-counting hand 259, the second-counting hand 255 and the 1/10 second-counting hand 275 are disposed at "zero positions (initial positions)". That is, in the reset state, all of the minute-counting hand 259, the second-counting hand 255 and the 1/10 second-counting hand 275 are disposed at positions indicating "zero".

In reference to FIG. 1 through FIG. 3, FIG. 7 and FIG. 8, when the start/stop button 206 is pushed to start measuring the chronograph, the chronograph measuring mode is started. In the chronograph measuring mode, the chronograph minute/second rotor 266 is rotated, and the chronograph minute/second-fifth wheel & pinion 250 is rotated based on rotation of the chronograph minute/second rotor 266. Further, the second-counter intermediate wheel (A) 251 and the minute-counter intermediate wheel (A) 252 are rotated based on rotation of the chronograph minute/second fifth wheel & pinion 250. The second-counting wheel 254 is rotated based on rotation of the second-counter intermediate wheel (A) 251 via rotation of the second-counter intermediate wheel (B) 253. In the chronograph measuring mode, the second-counting hand 255 attached to the second-counting wheel 254 indicates "second" in elapse time.

Further, the minute-counting wheel 258 is rotated based on rotation of the minute-counter intermediate wheel (A) 252 via rotation of the minute-counter intermediate wheel (B) 257. In the chronograph measuring mode, the minute-counting hand 259 attached to the minute-counting wheel 258 indicates "minute" of elapse time.

Further, in the chronograph measuring mode, the 1/10 second rotor 286 is rotated and the 1/10 fifth wheel & pinion 270 is rotated based on rotation of the 1/10 second rotor 286. The 1/10 second-counter intermediate wheel (B) 272 is rotated based on rotation of the 1/10 second fifth wheel & pinion 270 via rotation of the 1/10 second-counter intermediate wheel (A) 271. The 1/10 second-counting wheel 274 is rotated based on rotation of the 1/10 second-counter intermediate wheel (B) 272. In the chronograph measuring mode, the 1/10 second-counting hand 275 attached to the 1/10 second-counting wheel 274 is operated to indicate "second" in elapse time by "1/10 second unit".

In the chronograph measuring mode, when the start/stop button 206 is pushed further, measurement of the chronograph can be stopped. In a state of stopping to measure the chronograph, the minute-counting hand 259 is stopped in a state of indicating "minute" in elapse time, the second-counting hand 255 is stopped in a state of indicating "second" in elapse time and the 1/10 second-counting hand 275 is stopped in a state of indicating "second" in elapse time by "1/10 second unit".

When the reset button 208 is pushed, all of the minute-counting hand 259, the second-counting hand 255 and the 1/10 second-counting hand 275 return to positions indicating "zero" (refer to FIG. 8).

(2) Second Embodiment

Next, a second embodiment of the invention will be explained. The second embodiment of the invention is "center chronograph timepiece".

The following explanation will be carried out mainly with respect to a point of the second embodiment of the invention which differs from the first embodiment of the invention. Therefore, with regard to a portion other than content described below, the above-described explanation of the first embodiment of the invention will be applied thereto.

(2•1) Total Constitution of Movement

First, an explanation will be given of a total constitution of a movement of an analog chronograph timepiece according to the invention. In reference to FIG. 9 through FIG. 11, the analog chronograph timepiece of the invention is provided with a movement 400. The movement 400 is provided with the main plate 102 constituting the base plate of the movement 400, the train wheel bridge (A) 106, the train wheel bridge (B) 107 and the back train wheel bridge 108. The main plate 102, the train wheel bridge (A) 106, the train wheel bridge (B) 107 and the back train wheel bridge 108 are parts respectively the same as the main plate 102, the train wheel bridge (A) 106, the train wheel bridge (B) 107 and the back train wheel bridge 108 used in the above-described movement 100.

(2•2) Constitution of Time Indicating Train Wheel Portion

Next, a constitution of a time indicating train wheel portion will be explained. The time indicating train wheel portion includes a motor for driving a time indicating train wheel and the time indicating train wheel.

Figure 9:
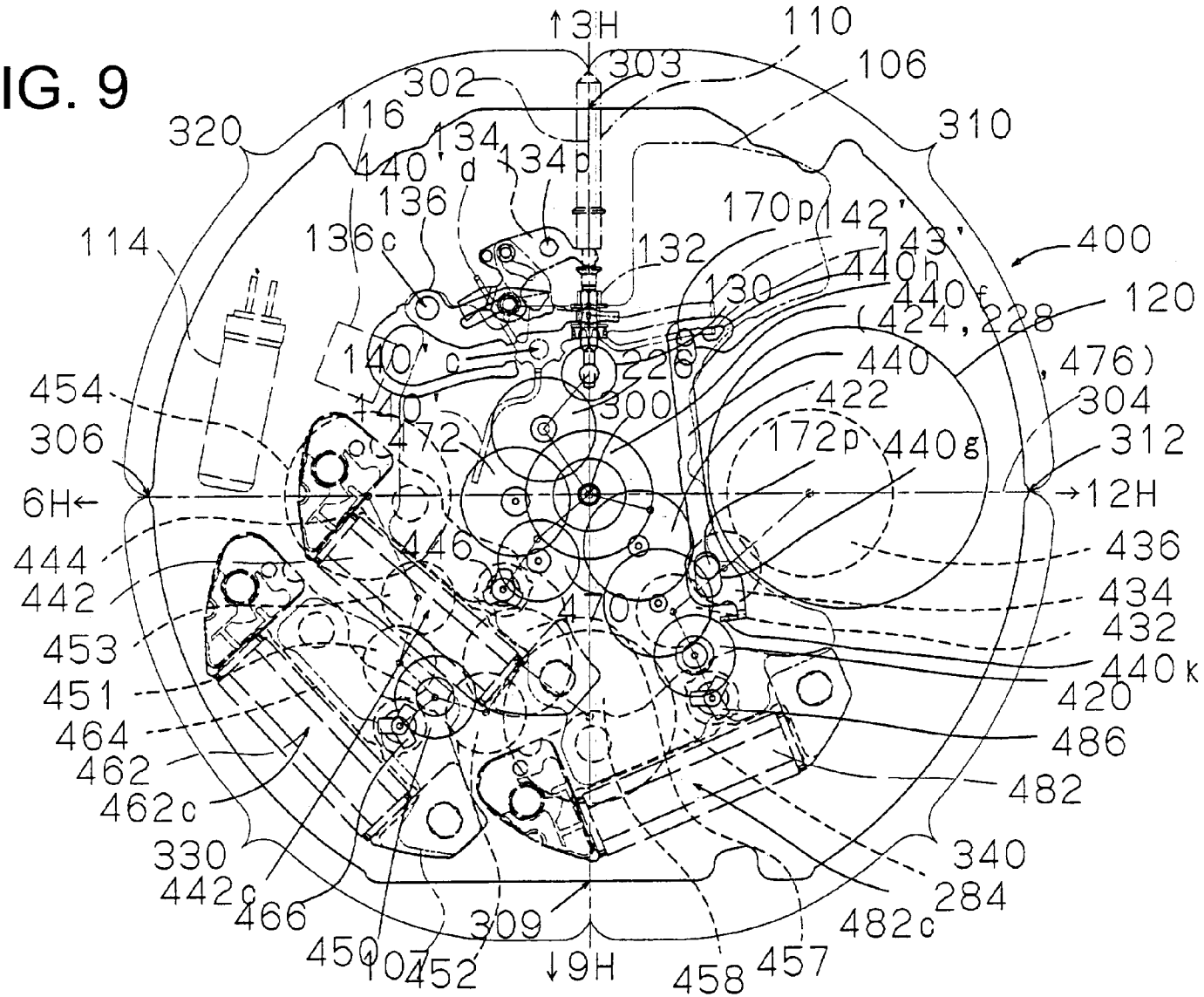
FIG. 9 is a plane view showing an outline shape by viewing a movement of a center chronograph timepiece from a surface side according to an embodiment of the chronograph timepiece of the invention (in FIG. 9, portions of parts are omitted)
Figure 10:
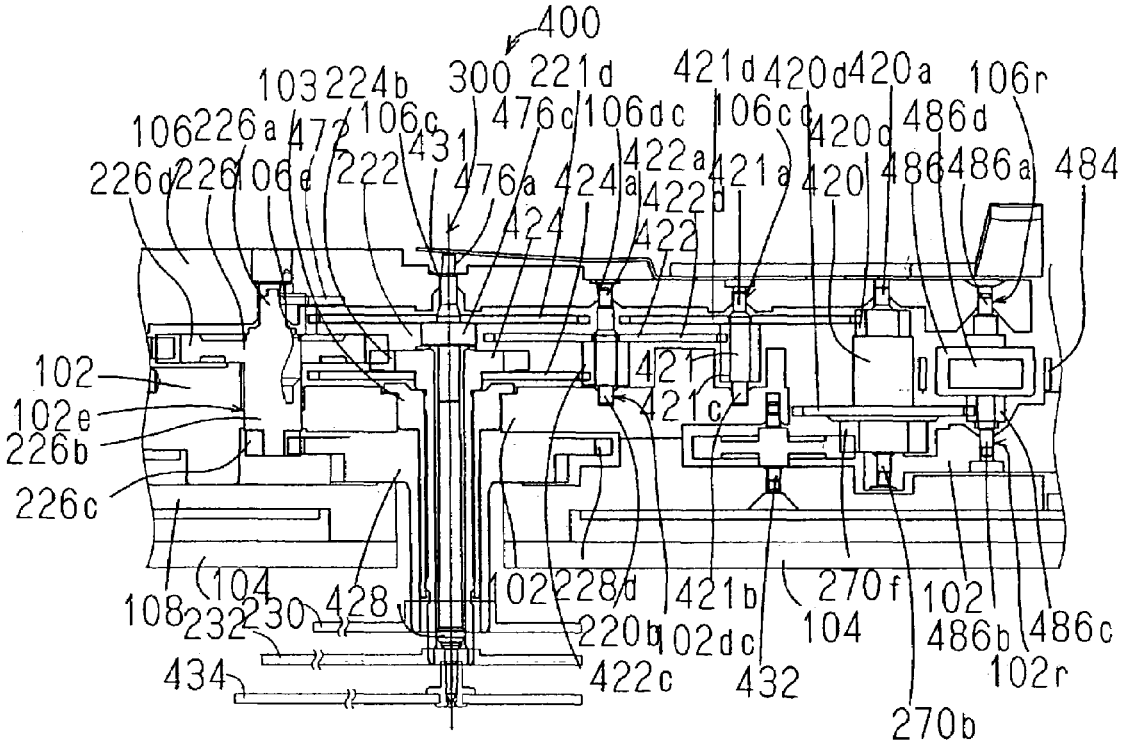
FIG. 10 is an outline partial sectional view showing a motor and a portion of a train wheel of a movement of the center chronograph timepiece according to the embodiment of the chronograph timepiece of the invention.
Figure 11:
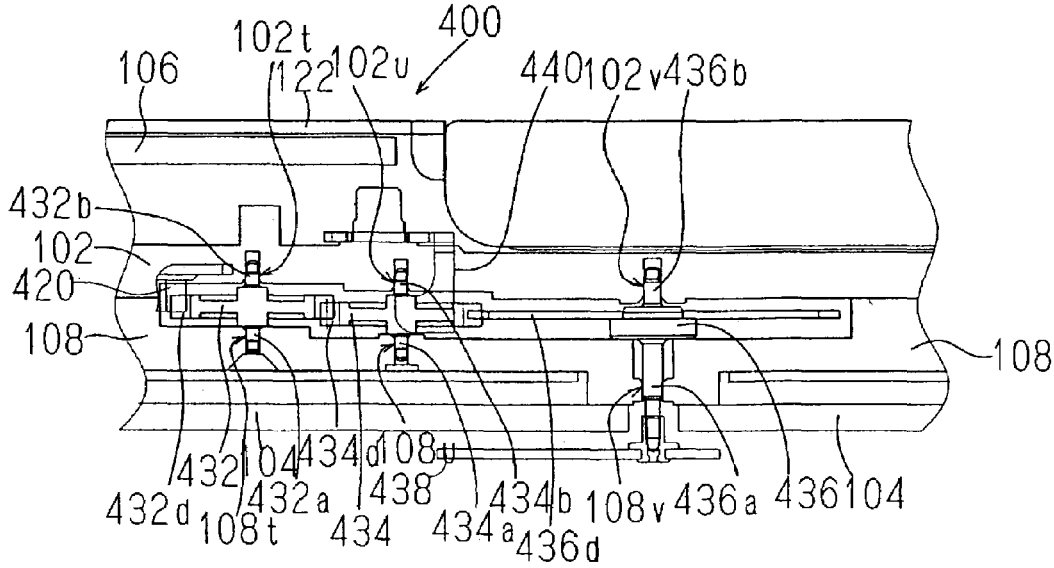
FIG. 11 is an outline partial sectional view showing a battery and a portion of the train wheel of the movement of the center chronograph timepiece according to the embodiment of the chronograph timepiece of the invention.
Figure 12:
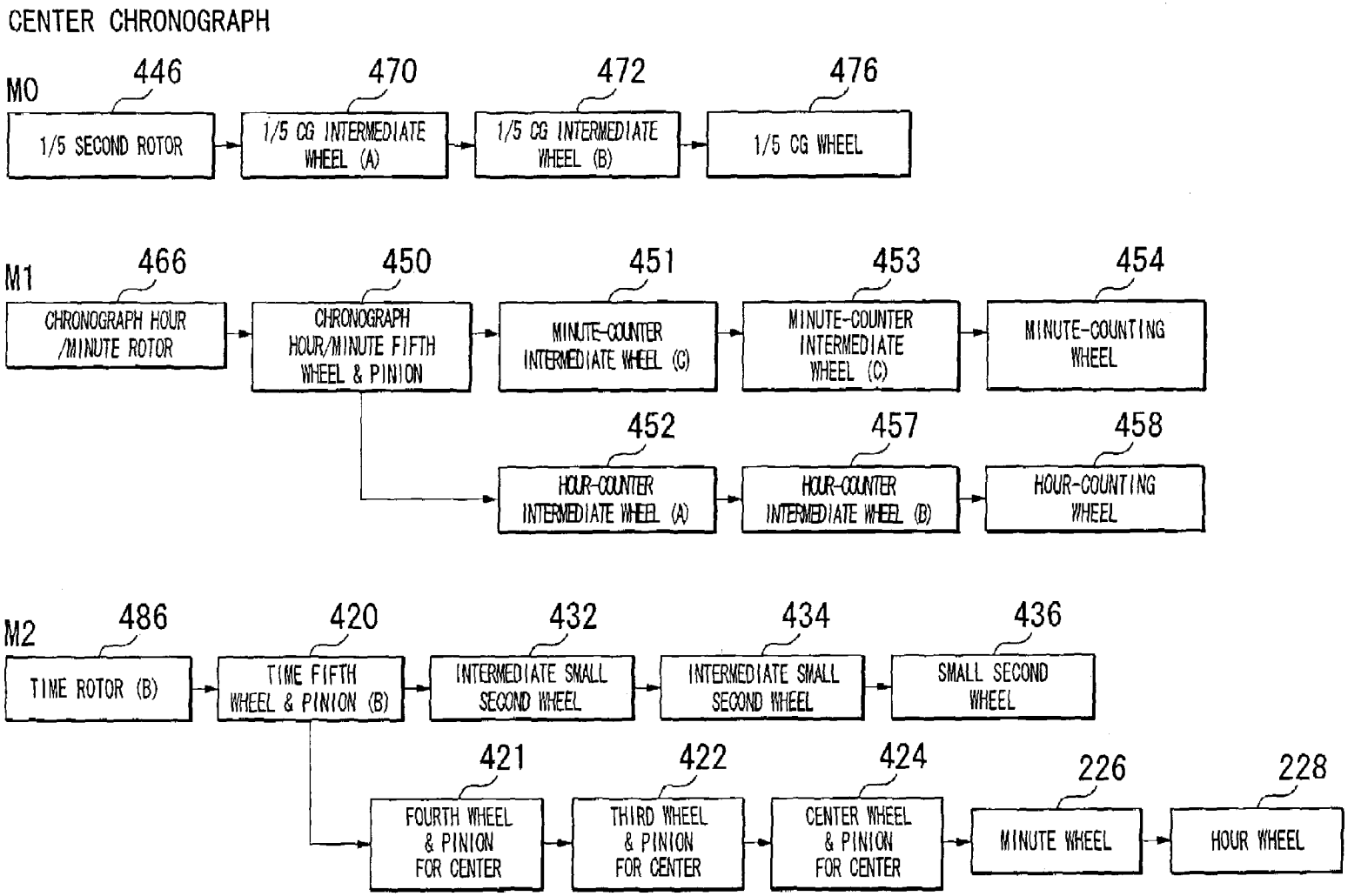
FIG. 12 is a block diagram of the motor and the train wheel of the movement of the center chronograph timepiece according to the embodiment of the chronograph timepiece of the invention.

In reference to FIG. 9 through FIG. 11, "surface side" of the movement 400 is arranged with a circuit block, the battery 120, a time train wheel portion for center, a chronograph hour/minute train wheel portion, a 1/5 second train wheel portion and a switching apparatus. A center wheel & pinion for center 424 is rotatably integrated to the center hole of the center pipe 103. The center wheel & pinion for center 424 includes a center wheel for center 424*a* and a cannon pinion for center 424*b*. The center wheel & pinion for center 424 used in the movement 400 is a part the same as that of the center wheel & pinion for side 224 used in the above-described movement 100.

The time train wheel portion for center includes a motor for driving the time train wheel for center, that is, a time motor for center and a time train wheel for center. The time train wheel for center is constituted to rotate by rotation of the time motor for center to thereby indicate "hour" in current time by the hour hand 203, indicate "minute" in current time by the minute hand 232 and indicate "second" in current time by a second hand (that is, small second hand) 434.

The time motor for center includes a time coil block for center 482, a time stator for center 484 and a time rotor for center, that is, a time rotor (B) 486. The time coil block for center 482, the time stator for center 484, and the time rotor (B) 486 are parts respectively the same as the 1/10 second coil block 282, the 1/10 second stator 284 and the 1/10 second rotor 286 used in the above-described movement 100.

When a time motor drive signal outputted by IC (Integrated Circuit) 116 is inputted to the time coil block 242, the time stator for center 484 is magnetized to rotate the time rotor (B) 486. According to IC (Integrated Circuit) 116, IC for a side chronograph timepiece and IC for a center chronograph timepiece can be fabricated separately or single IC can be dividedly used for two functions by switching a conductive state of two of function setting terminals by constituting IC for a side chronograph timepiece and IC for a center chronograph timepiece by the same IC. For example, the embodiment of the invention can be constituted such that IC (Integrated Circuit) 116 is provided with a terminal TS for a side chronograph timepiece and a terminal TC for a center chronograph timepiece and when the terminal TS is conducted to plus of the battery 120, IC 116 is operated as IC for the side chronograph timepiece and when the terminal TC is conducted to plus of the battery 120, IC 116 is operated as IC for the center chronograph timepiece. That is, according to the embodiment of the invention, IC for the side chronograph timepiece is a part the same as IC for the center chronograph timepiece.

The time rotor (B) 486 is constituted to rotate by, for example, 180 degrees per second. The time rotor (B) 486 includes an upper shaft portion 486*a*, a lower shaft portion 486*b*, a pinion portion 486*c* and a rotor magnet 486*d*. The upper shaft portion 486*a* of the time rotor (B) 486 is rotatably integrated to a time rotor (B) upper bearing portion 106*a* provided at the train wheel bridge (A) 106. The time rotor (B) upper bearing portion 106*a* is the same as the time rotor (A) upper bearing portion 106*a* used in the above-described movement 100. The lower shaft portion 486*b* of the time rotor (A) 486 is rotatably integrated to a time rotor (B) lower bearing portion 102*a* provided at the main plate 102. The time rotor (B) lower bearing portion 102*a* is the same as the time rotor (A) lower bearing portion 102*a* used in the above-described movement 100. Therefore, the time rotor (B) 486 is rotatably arranged between the train wheel bridge (A) 106 and the main plate 102.

A time fifth wheel & pinion for center, that is, a time fifth wheel & pinion (B) 420 is constituted to rotate based on rotation of the time rotor (B) 486. The time fifth wheel & pinion (B) 420 used in the movement 400 is a part the same as the 1/10 second fifth wheel & pinion 270 used in the above-described movement 100. The time fifth wheel & pinion (B) 420 includes an upper shaft portion 420*a*, a lower shaft portion 420*b*, an upper pinion portion 420*c*, a wheel portion 420*d* and a lower pinion portion 420*f*. The wheel portion 420*d* of the time fifth wheel & pinion (B) 420 is constituted to be brought in mesh with the pinion portion 486*c* of the time rotor (B) 486. The upper shaft portion 420*a* of the time fifth wheel & pinion (B) 420 is rotatably integrated to a time fifth wheel & pinion (B) upper bearing portion 106*s* provided at the train wheel bridge (A) 106. The time fifth wheel & pinion (B) upper bearing portion 106*s* is the same as the 1/10 second fifth wheel & pinion upper bearing portion 106*s* used in the above-described movement 100. The lower shaft portion 420*b* of the time fifth wheel & pinion (B) 420 is rotatably integrated to a time fifth wheel & pinion (B) lower bearing portion 102*s* provided at the main plate 102. The time fifth wheel &pinion (B) lower bearing portion 102*s* used in the movement 400 is the same as the 1/10 second fifth wheel & pinion lower bearing portion 102*s* used in the above-described movement 100. Therefore, the time fifth wheel & pinion (B) 420 is rotatably arranged between the train wheel bridge (A) 106 and the main plate 102.

A fourth wheel & pinion for center 421 and an intermediate small second wheel 432 are constituted to rotate based on rotation of the time fifth wheel & pinion (B) 420. The fourth wheel & pinion for center 421 includes an upper shaft portion 421*a*, a lower shaft portion 421*b*, a pinion portion

421*c* and a wheel portion 421*d*. The wheel portion 421*d* of the fourth wheel & pinion for center 421 is constituted to be brought in mesh with the upper pinion portion 420*c* of the time fifth wheel & pinion (B) 420. The upper shaft portion 421*a* of the fourth wheel & pinion for center 421 is rotatably integrated to a center fourth wheel & pinion upper bearing portion 106*cc* provided at the train wheel bridge (A) 106. The lower shaft portion 421*b* of the fourth wheel & pinion for center 421 is rotatably integrated to a center fourth wheel & pinion lower bearing portion 102*cc* provided at the main plate 102. Therefore, the fourth wheel & pinion for center 421 is arranged rotatably between the train wheel bridge (A) 106 and the main plate 102.

The center wheel & pinion for center 424 is constituted to rotate based on rotation of the fourth wheel & pinion for center 421 via rotation of a third wheel & pinion for center 422. The third wheel & pinion for center 422 includes an upper shaft portion 422*a*, a lower shaft portion 422*b*, a pinion portion 422*c* and a wheel portion 422*d*. The wheel portion 422*d* of the third wheel & pinion for center 422 is constituted to be brought in mesh with the pinion portion 421*c* of the fourth wheel & pinion for center 421. The upper shaft portion 422*a* of the third wheel & pinion for center 422 is rotatably integrated to a center third wheel & pinion upper bearing portion 106*dc* provided at the train wheel bridge (A) 106. The lower shaft portion 422*b* of the third wheel & pinion for center 422 is rotatably integrated to a center third wheel & pinion lower bearing portion 102*dc* provided at the main plate 102. Therefore, the third wheel & pinion for center 422 is rotatably arranged between the train wheel bridge (A) 106 and the main plate 102. The center wheel & pinion for center 424 is constituted to rotate by one rotation per hour. The minute hand 232 is attached to a cannon pinion for center 424*b* of the center wheel & pinion for center 424.

The lower wheel 228 is constituted to rotate based on rotation of the center wheel & pinion for center 424 via rotation of the minute wheel 226. The minute wheel 226 and the hour wheel 228 used in the movement 400 are parts respectively the same as the minute wheel 226 and the hour wheel 228 used in the above-described movement 100. Rotation center of the hour wheel 228 is disposed at a position the same as rotation center of the center wheel & pinion for center 224. However, rotation center of the fourth wheel & pinion for center 421 is disposed at a position different from rotation center of the center wheel & pinion for center 224. The hour wheel 228 is constituted to rotate by one rotation per 12 hours.

An intermediate small second wheel (A) 432 is constituted to rotate based on rotation of the time fifth wheel & pinion (B) 420. The intermediate small second wheel (A) 432 includes an upper shaft portion 432*a*, a lower shaft portion 432*b* and a wheel portion 432*d*. The wheel portion 432*d* of the intermediate small second wheel (A) 432 is constituted to be brought in mesh with the lower pinion portion 420*f* of the time fifth wheel & pinion (B) 420. The upper shaft portion 432*a* of the intermediate small second wheel (A) 432 is rotatably integrated to an intermediate small second wheel (A) upper bearing portion 108*t* provided at the back train wheel bridge 108. The intermediate small second wheel (A) upper bearing portion 108*t* used in the movement 400 is the same as the 1/10 second-counter intermediate wheel (A) upper bearing portion 108*t* used in the above-described movement 100. The lower shaft portion 432*b* of the intermediate small second wheel (A) 432 is rotatably integrated to an intermediate small second wheel (A) lower bearing portion 102*t* provided at the main plate 102. The intermediate small second wheel (A) lower bearing portion 102*t* used in the movement 400 is the same as the 1/10 second-counter intermediate wheel (A) lower bearing portion 102*t* used in the above-described movement 100. Therefore, the intermediate small second wheel (A) 432 is arranged rotatably between the back train wheel bridge 108 and the main plate 102.

A small second wheel 436 is constituted to rotate based on rotation of the intermediate small second wheel (A) 432 via rotation of an intermediate small second wheel (B) 434. Dimensions and shape of the intermediate small second wheel (A) 432 are constituted to be the same as dimensions and shape of the intermediate small second wheel (B) 434. Further, dimensions and shape of the intermediate small second wheel (A) 432, dimensions and shape of the intermediate small second wheel (B) 434, dimensions and shape of the second-counter intermediate wheel (A) 251 and dimensions and shape of the second-counter intermediate wheel (B) 253 are the same.

The intermediate small second wheel (B) 434 includes an upper shaft portion 434*a*, a lower shaft portion 434*b* and a wheel portion 434*d*. The wheel portion 434*d* of the intermediate small second wheel (B) 434 is constituted to be brought in mesh with the wheel portion 432*d* of the intermediate small second wheel (A) 432. The upper shaft portion 434*a* of the intermediate small second wheel (B) 434 is rotatably integrated to an intermediate small second wheel (B) upper bearing portion 108*u* provided at the back train wheel bridge 108. The intermediate small second wheel (B) upper bearing portion 108*u* used in the movement 400 is the same as the 1/10 second-counter intermediate wheel (B) upper bearing portion 108*u* used in the above-described movement 100. The lower shaft portion 434*b* of the intermediate small second wheel (B) 434 is rotatably integrated to an intermediate small second wheel (B) lower bearing portion 102*u* provided at the main plate 102. The intermediate small second wheel (B) lower bearing portion 102*u* used in the movement 400 is the same as the 1/10 second-counter intermediate wheel (B) lower bearing portion 102*u* used in the above-described movement 100. Therefore, the intermediate small second wheel (B) is rotatably arranged between the back train wheel bridge 108 and the main plate 102.

The small second wheel 436 includes an upper shaft portion 436*a*, a lower shaft portion 436*b* and a wheel portion 436*d*. The wheel portion 436*d* of the small second wheel 436 is constituted to be brought in mesh with the wheel portion 434*d* of the intermediate small second wheel (B) 434. The upper shaft portion 436*a* of the small second wheel 436 is rotatably integrated to a small second wheel upper bearing portion 108*v* provided at the back train wheel bridge 108. The small second wheel upper bearing portion 108*v* used in the movement 400 is the same as the 1/10 second-counting wheel upper bearing portion 102*v* used in the above-described movement 100. The lower shaft portion 436*b* of the small second wheel 436 is rotatably integrated to a small second wheel lower bearing portion 102*v* provided at the main plate 102. The small second wheel lower bearing portion 102*v* used in the movement 400 is the same as the 1/10 second-counting wheel lower bearing portion 102*v* used in the above-described movement 100. Therefore, the small second wheel 436 is rotatably arranged between the back train wheel bridge 108 and the main plate 102. A small second hand 438 is attached to the small second wheel 436. The small second hand 438 constitutes a second indicating member.

In reference to FIG. 9, rotation center of the small second wheel 436 is disposed at a position above the main plate reference horizontal axis line 304 and between the main plate center 300 and the outer shape portion 312 of the main plate 102 disposed in "12 o'clock direction" of the movement 400. The distance between rotation center of the small second wheel 436 and the main plate center 300 is about ½ of a radius of a maximum outer shape portion of the main plate 102.

In reference to FIG. 9 and FIG. 11, a reset lever 140' includes the reset conduction spring 140*d* for carrying out resetting operation, a train wheel resetting lever holding portion 142 for holding a train wheel setting lever 440 and the operation spring 143 for operating the train wheel setting lever 440. Dimensions and shape of the reset lever 140' can be made the same as dimensions and shape of the reset lever 140 used in the above-described movement 100 except that there is not the train wheel setting portion 140*f*.

In a state of pulling out the hand setting stem 110 to the first stage, the analog chronograph timepiece is constituted to be able to reset by conducting the reset conduction spring 140*d* of the reset lever 140' to a reset pattern of the circuit block. In the state of pulling out the hand setting stem 110 to the first stage, the train wheel setting lever 440 is constituted to be able to set rotation of the intermediate small second wheel (B) 434 based on operation of the reset lever 140'. The train wheel setting lever 440 includes guide window portions 440*f* and 440*g* having a shape of a long hole, an operation window portion 440*h* inserted with the operation spring 143 of the reset lever 140' and a train wheel setting portion 440*k* for setting rotation of the intermediate small second wheel (B) 434. The main plate 102 is provided with two guide pins 170*p* and 172*p* respectively inserted into the guide window portions 440*f* and 440*g* of the train wheel setting lever 440. The guide window portion 440*f* of the train wheel setting lever 440 is guided by the guide pin 170*p* of the main plate 102. The guide window portion 440*g* of the train wheel setting lever 440 is guided by the guide pin 172*p* of the main plate 102. Therefore, the train wheel setting lever 440 is integrated to the main plate 102 to be able to move linearly relative to the main plate 102.

The train wheel setting lever 440 is arranged not to overlap the battery 120. Further, the train wheel setting lever 440 is arranged not to overlap a part attached with a hand. The operation window portion 440*h* of the train wheel setting lever 440 is inserted with the operation spring 143 of the reset lever 140'. When the hand setting stem 110 is pulled out to the first stage, the reset lever 140' is rotated. When the reset lever 140' is rotated, by rotation of the operation spring 143 the train wheel setting lever 440 can linearly be moved by being guided by the guide pins 170*p* and 172*p*. When the train wheel setting lever 440 is linearly moved, the train wheel setting portion 440*k* of the train wheel setting lever 440 can set rotation of the intermediate small second wheel (B) 434.

(2•3) Constitution of Chronograph Hour/Minute Indicating Train Wheel Portion

Next, an explanation will be given of a constitution of a chronograph hour/minute indicating train wheel portion operated in the chronograph measuring mode in the analog chronograph timepiece according to the invention. The chronograph hour/minute indicating train wheel portion includes a motor for driving a chronograph hour/minute indicating train wheel and the chronograph hour/minute indicating train wheel.

In reference to FIG. 9, the chronograph hour/minute indicating train wheel portion includes the motor for driving the chronograph hour/minute indicating train wheel, that is, a chronograph hour/minute motor and the chronograph hour/minute indicating train wheel. The chronograph hour/minute indicating train wheel is constituted to rotate by rotation of the chronograph hour/minute motor to indicate "chronograph minute" in elapse time measured in the chronograph measuring mode by a chronograph minute hand and to indicate "chronograph hour" in elapse time measured in the chronograph measuring mode by a chronograph hour hand. In the chronograph measuring mode, IC (Integrated Circuit) 116 is constituted to measure elapse time and operate the chronograph hour/minute motor.

The chronograph hour/minute motor includes a chronograph hour/minute coil block 462, a chronograph hour/minute stator 464 and a chronograph hour/minute rotor 466. The chronograph hour/minute coil block 462, the chronograph hour/minute stator 464 and the chronograph hour/minute rotor 466 used in the movement 400 are parts respectively the same as the chronograph minute/second coil block 262, the chronograph minute/second stator 264 and the chronograph minute/second rotor 266 used in the above-described movement 100.

When a chronograph hour/minute motor drive signal outputted by IC (Integrated Circuit) 116 is inputted to the chronograph hour/minute coil block 462, the chronograph hour/minute stator 464 is magnetized to rotate the chronograph hour/minute rotor 466. The chronograph hour/minute rotor 466 is constituted to rotate by, for example, 180 degrees per minute. The chronograph hour/minute rotor 466 can also be constituted to rotate by 180 degrees per 10 seconds, 20 seconds or 30 seconds. The chronograph hour/minute rotor 466 includes an upper shaft portion, a lower shaft portion, a pinion portion and a rotor magnet. The upper shaft portion of the chronograph hour/minute rotor 466 is rotatably integrated to a chronograph hour/minute rotor upper bearing portion 107*f* provided at the train wheel bridge (B) 107. The chronograph hour/minute rotor upper bearing portion 107*f* used in the movement 400 is the same as the chronograph minute/second rotor upper bearing portion 107*f* used in the above-described movement 100. The lower shaft portion of the chronograph hour/minute rotor 466 is rotatably integrated to a chronograph hour/minute rotor lower bearing portion 102*f* provided at the main plate 102*f*. The chronograph hour/minute rotor lower bearing portion 102*f* used in the movement 400 is the same as the chronograph minute/second rotor lower bearing portion 102*f* used in the above-described movement 100. Therefore, the chronograph hour/minute rotor 466 is rotatably arranged between the train wheel bridge (B) 107 and the main plate 102.

A chronograph hour/minute fifth wheel & pinion 450 is constituted to rotate based on rotation of the chronograph hour/minute rotor 466. A minute-counter intermediate wheel (C) 451 and a second-counter intermediate wheel (A) 452 are constituted to rotate based on rotation of the chronograph hour/minute fifth wheel & pinion 450. The chronograph hour/minute fifth wheel & pinion 450 includes an upper shaft portion, a lower shaft portion, a pinion portion and a wheel portion. The wheel portion of the chronograph hour/minute fifth wheel & pinion 450 is constituted to be brought in mesh with the pinion portion of the chronograph hour/minute rotor 466. The upper shaft portion of the chronograph hour/minute fifth wheel & pinion 450 is rotatably integrated to a chronograph hour/minute fifth wheel & pinion upper bearing portion 107*g* provided at the train wheel bridge (B) 107. The chronograph hour/minute fifth wheel & pinion upper bearing portion 107*g* used in the movement 400 is the same as the chronograph minute/ second fifth wheel & pinion upper bearing portion 107*g* used in the above-described movement 100. The lower shaft portion of the chronograph hour/minute fifth wheel & pinion 450 is rotatably integrated to a chronograph hour/minute fifth wheel & pinion lower bearing portion 102*g* provided at the main plate 102. The chronograph hour/minute fifth wheel & pinion lower bearing portion 102*g* used in the movement 400 is the same as the chronograph minute/second fifth wheel & pinion lower bearing portion 102*g* used in the above-described movement 100. Therefore, the chronograph hour/minute fifth wheel & pinion 450 is rotatably arranged between the train wheel bridge (B) 107 and the main plate 102.

A minute-counting wheel 454 is constituted to rotate based on rotation of the minute-counter intermediate wheel (C) 451 via rotation of a minute-counter intermediate wheel (D) 453. Dimensions and shape of the minute-counter intermediate wheel (C) 451 are constituted to be same as dimensions and shape of the minute-counter intermediate wheel (D) 453. Further, all of dimensions and shape of the minute-counter intermediate wheel (C) 451, dimensions and shape of the minute-counter intermediate wheel (D) 453, dimensions and shape of the second-counter intermediate wheel (A) 251 and dimensions and shape of the second-counter intermediate wheel (B) 253 are the same.

The minute-counter intermediate wheel (C) 451 includes an upper shaft portion, a lower shaft portion and a wheel portion. The wheel portion of the minute-counter intermediate wheel (C) 451 is constituted to be brought in mesh with the pinion portion of the chronograph hour/minute fifth wheel & pinion 450. The upper shaft portion of the minute-counter intermediate wheel (C) 451 is rotatably integrated to a minute-counter intermediate wheel (C) upper bearing portion 108*h* provided at the back train wheel bridge 108. The minute-counter intermediate wheel (C) upper bearing portion 108*h* used in the movement 400 is the same as the second-counter intermediate wheel (A) upper bearing portion 108*h* used in the above-described movement 100. The lower shaft portion of the minute-counter intermediate wheel (C) 451 is rotatably integrated to a minute-counter intermediate wheel (C) lower bearing portion 102*h* provided at the main plate 102. The minute-counter intermediate wheel (C) lower bearing portion 102*h* used in the movement 400 is the same as the second-counter intermediate wheel (A) lower bearing portion 102*h* used in the above-described movement 100. Therefore, the minute-counter intermediate wheel (C) 451 is rotatably arranged between the back train wheel bridge 108 and the main plate 102.

The minute-counter intermediate wheel (D) 453 includes an upper shaft portion, a lower shaft portion and a wheel portion. The wheel portion of the minute-counter intermediate wheel (D) 453 is constituted to be brought in mesh with the wheel portion of the minute-counter intermediate wheel (C) 451. The upper shaft portion of the minute-counter intermediate wheel (D) 453 is rotatably integrated to a minute-counter intermediate wheel (D) upper bearing portion 108*j* provided at the back train wheel bridge 108. The minute-counter intermediate wheel (D) upper bearing portion 108*j* used in the movement 400 is the same as the second-counter intermediate wheel (B) upper bearing portion 108*j* used in the above-described movement 100. The lower shaft portion of the minute-counter intermediate wheel (D) 453 is rotatably integrated to a minute-counter intermediate wheel (D) lower bearing portion 102*j* provided at the main plate 102. The minute-counter intermediate wheel (D) lower bearing portion 102*j* used in the movement 400 is the same as the second-counter intermediate wheel (B) lower bearing portion 102*j* used in the above-described movement 100. Therefore, the minute-counter intermediate wheel (D) 453 is rotatably arranged between the back train wheel bridge 108 and the main plate 102.

The minute-counting wheel 454 is constituted to rotate based on rotation of the minute-counter intermediate wheel (D) 453. The minute-counting wheel 454 includes an upper shaft portion, a lower shaft portion and a wheel portion. The wheel portion of the minute-counting wheel 454 is constituted to be brought in mesh with the wheel portion of the minute-counter intermediate wheel (D) 453. The upper shaft portion of the minute-counting wheel 454 is rotatably integrated to a minute-counting wheel upper bearing portion 108*k* provided at the back train wheel bridge 108. The minute-counting wheel upper bearing portion 108*k* used in the movement 400 is the same as the second-counting wheel upper bearing portion 108*k* used in the above-described movement 100. The lower shaft portion of the minute-counting wheel 454 is rotatably integrated to a minute-counting wheel lower bearing portion 102*k* provided at the main plate 102. The minute-counting wheel lower bearing portion 102*k* used in the movement 400 is the same as the second-counting wheel lower bearing portion 102*k* used in the above-described movement 100. Therefore, the minute-counting wheel 454 is rotatably arranged between the back train wheel bridge 108 and the main plate 102. A minute-counting hand 455 (refer to a view of a complete, mentioned later) is attached to the minute-counting wheel 454. The chronograph minute hand 455 constitutes a minute chronograph indicating member. In the chronograph measuring mode, the chronograph minute hand 455 is operated to indicate "minute" in elapse time.

In reference to FIG. 9, rotation center of the minute-counting wheel 454 is disposed at a position above the main plate reference horizontal axis line 304 and between the main plate center 300 and the outer shape portion 306 of the main plate 102 disposed in "6 o'clock direction" of the movement 100. A distance between rotation center of the minute-counting wheel 454 and the main plate center 300 is about ½ of a maximum outer shape portion of the main plate 102.

An hour-counting wheel 458 is constituted to rotate based on rotation of an hour/counter intermediate wheel (A) 452 via rotation of an hour-counter intermediate wheel (B) 457. The hour/counter intermediate wheel (A) 452 includes an upper shaft portion, a lower shaft portion, a pinion portion and a wheel portion. The wheel portion of the hour-counter intermediate wheel (A) 452 is constituted to be brought in mesh with the pinion portion of the chronograph hour/minute fifth wheel & pinion 450. The upper shaft portion of the hour-counter intermediate wheel (A) 452 is rotatably integrated to an hour-counter intermediate wheel (A) upper bearing portion 108*m* provided at the back train wheel bridge 108. The hour-counter intermediate wheel (A) upper bearing portion 108*m* used in the movement 400 is the same as the minute-counter intermediate wheel (A) upper bearing portion 108*m* used in the above-described movement 100. The lower shaft portion of the hour-counter intermediate wheel (A) 452 is rotatably integrated to an hour-counter intermediate wheel (A) lower bearing portion 102*m* provided at the main plate 102. The hour-counter intermediate wheel (A) lower bearing portion 102*m* used in the movement 400 is the same as the minute-counter intermediate wheel (A) lower bearing portion 102*m* used in the above-described movement 100. Therefore, the hour-counter intermediate wheel (A) 452 is rotatably arranged between the back train wheel bridge 108 and the main plate 102.

The hour-counter intermediate wheel (B) 457 includes an upper shaft portion, a lower shaft portion, a pinion portion and a wheel portion. The hour-counter intermediate wheel (B) 457 is constituted to be brought in mesh with the pinion portion of the hour-counter intermediate wheel (A) 452. The upper shaft portion of the hour-counter intermediate wheel (B) 457 is rotatably integrated to an hour-counter intermediate wheel (B) upper bearing portion 108*n* provided at the back train wheel bridge 108. The hour-counter intermediate wheel (B) upper bearing portion 108*n* used in the movement 400 is the same as the minute-counter intermediate wheel (A) upper bearing portion 108*n* used in the above-described movement 100. The lower shaft portion of the hour-counter intermediate wheel (B) 457 is rotatably integrated to an hour-counter intermediate wheel (B) lower bearing portion 102*n* provided at the main plate 102. The hour-counter intermediate wheel (A) lower bearing portion 102*n* used in the movement 400 is the same as the minute-counter intermediate wheel (A) lower bearing portion 108*n* used in the above-described movement 100. Therefore, the hour-counter intermediate wheel (B) 457 is rotatably arranged between the back train wheel bridge 108 and the main plate 102.

The hour-counting wheel 458 includes an upper shaft portion, a lower shaft portion and a wheel portion. The wheel portion of the hour-counting wheel 458 is constituted to be brought in mesh with the wheel portion of the minute-counter intermediate wheel (B) 257. The upper shaft portion of the hour-counting wheel 458 is rotatably integrated to an hour-counting wheel upper bearing portion 108*p* provided at the back train wheel bridge 108. The hour-counting wheel upper bearing portion 108*p* used in the movement 400 is the same as the minute-counting wheel upper bearing portion 108*p* used in the above-described movement 100. The lower shaft portion of the hour-counting wheel 458 is rotatably integrated to an hour-counting wheel lower bearing portion 102*p* provided at the main plate 102. The hour-counting wheel lower bearing portion 102*p* used in the movement 400 is the same as the minute-counting wheel lower bearing portion 102*p* used in the above-described movement 100. Therefore, the hour-counting wheel 458 is rotatably arranged between the back train wheel bridge 108 and the main plate 102. An hour chronograph hand 459 (refer to a view of a complete, mentioned later) is attached to the hour-counting wheel 458. The hour-counting hand 459 constitutes an hour chronograph indicating member. In the chronograph measuring mode, the hour chronograph hand 459 is operated to indicate "hour" in elapse time.

In reference to FIG. 1, rotation center of the hour-counting wheel 458 is disposed at a position above the main plate reference vertical axis line 302 and between the main plate center 300 and the outer shape portion 309 of the main plate 102 disposed in "9 o'clock direction" of the movement 400. A distance between rotation center of the hour-counting wheel 458 and the main plate center 300 is about ½ of a radius of a maximum outer shape portion of the main plate 102.

(2•4) Constitution of ⅕ Second Indicating Train Wheel Portion

Next, an explanation will be given of a constitution of a ⅕ second indicating train wheel portion operated in the chronograph measuring mode in the analog chronograph timepiece according to the invention. A 1/10 second indicating train wheel portion includes a motor for driving a 1/10 second indicating train wheel and the ⅕ second indicating train wheel.

In reference to FIG. 9 and FIG. 10, a ⅕ second motor includes a ⅕ second coil block 442, a ⅕ second stator 444 and a ⅕ second rotor 446.

The ⅕ second coil block 442 and the ⅕ second rotor 446 used in the movement 400 are parts respectively the same as the time coil block for side 242 and the time rotor (A) 246 used in the above-described movement 100. Dimensions and shape of the ⅕ second stator 444 used in the movement 400 are the same as dimensions and shape of the time stator for side 244 used in the above-described movement 100 except a shape of a notch portion for controlling to rotate the time rotor (A) 246.

When a ⅕ motor drive signal outputted by IC (Integrated Circuit) 116 is inputted to the ⅕ second coil block 442, the ⅕ second stator 444 is magnetized to rotate the ⅕ second rotor 446. The ⅕ second rotor 446 is constituted to rotate by, for example, 180 degrees per ⅕ second. The ⅕ second rotor 446 includes an upper shaft portion, a lower shaft portion, a pinion portion and a rotor magnet. The upper shaft portion of the ⅕ second rotor 446 is rotatably integrated to a ⅕ second rotor upper bearing portion 106*a* provided at the train wheel bridge (A) 106. The ⅕ second rotor upper bearing portion 106*a* used in the movement 400 is the same as the time rotor (A) upper bearing portion 106*a* used in the above-described movement 100. The lower shaft portion of the ⅕ second rotor 446 is rotatably integrated to a ⅕ second rotor bearing portion 102*a* provided at the main plate 102. The ⅕ second rotor lower bearing portion 102*a* used in the movement 400 is the same as the time rotor (A) lower bearing portion 102*a* used in the above-described movement 100. Therefore, the ⅕ second rotor 446 is rotatably arranged between the train wheel bridge (A) 106 and the main plate 102.

A ⅕ CG intermediate wheel (A) 470 is constituted to rotate based on rotation of the ⅕ second rotor 446. The ⅕ CG intermediate wheel (A) 470 includes an upper shaft portion, a lower shaft portion, a pinion portion and a wheel portion. The wheel portion of the ⅕ CG intermediate wheel (A) 470 is constituted to be brought in mesh with the pinion portion of the ⅕ second rotor 446. The upper shaft portion of the ⅕ CG intermediate wheel (A) 470 is rotatably integrated to a ⅕ CG intermediate wheel (A) upper bearing portion 106*fc* (refer to a view of a train wheel bridge (A), mentioned later) provided at the train wheel bridge (A) 106. The lower shaft portion of the ⅕ CG intermediate wheel (A) 470 is rotatably integrated to a ⅕ CG intermediate wheel (A) lower bearing portion 102*fc* (refer to a view of a main plate, mentioned later) provided at the main plate 102. Therefore, the ⅕ CG intermediate wheel (A) 470 is rotatably arranged between the train wheel bridge (A) 106 and the main plate 102.

A ⅕ CG wheel 476 is constituted to rotate based on rotation of the ⅕ CG intermediate wheel (A) 470 via rotation of a ⅕ CG intermediate wheel (B) 472. The ⅕ CG intermediate wheel (B) 472 includes an upper shaft portion, a lower shaft portion and a wheel portion. The wheel portion of the ⅕ CG intermediate wheel (B) 472 is constituted to be brought in mesh with the pinion portion of the ⅕ CG intermediate wheel (A) 470. The upper shaft portion of the ⅕ CG intermediate wheel (B) 472 is rotatably integrated to a ⅕ CG intermediate wheel (B) upper bearing portion 106*gc* (refer to a view of a train wheel bridge, mentioned later) provided at the train wheel bridge (A) 106. The lower shaft portion of the ⅕ CG intermediate wheel (B) 472 is rotatably integrated to a ⅕ CG intermediate wheel (B) lower bearing portion 102*gc* (refer to a view of a main plate, mentioned later) provided at the main plate 102. Therefore, the ⅕0 CG intermediate wheel (B) 472 is rotatably arranged between the train wheel bridge (A) 106 and the main plate 102.

The ⅕ CG wheel 476 includes an upper shaft portion 476*a*, an abacus bead portion 476*b* provided at a lower shaft portion thereof, a middle shaft portion 476*c* and a wheel portion 476*d*. The wheel portion 221*d* of the ⅕ CG wheel 476 is constituted to be brought in mesh with the pinion portion 220*c* of the ⅕ CG intermediate wheel (B) 472. The upper shaft portion 476 of the ⅕ CG wheel 476 is rotatably integrated to the ⅕ CG wheel upper bearing portion 106*c* provided at the train wheel bridge (A) 106. The ⅕ CG upper bearing portion 106*c* used in the movement 400 is the same as the second wheel & pinion upper bearing portion for side 106*c* used in the above-described movement 100. The abacus bead portion 476*b* of the ⅕ CG wheel 476 is rotatably arranged to inside of a center hole of a cannon pinion for center 424*b*. The rotation center of the ⅕ CG wheel 476 is the main plate center 300. The ⅕ CG wheel 476 is constituted to rotate by one step per ⅕ second. A ⅕ second chronograph hand 475 is attached to the ⅕ CG wheel 476. The ⅕ second chronograph hand 475 constitutes a ⅕ second chronograph indicating member (⅕ CG indicating member).

In the movement 400, the second wheel & pinion hold spring for side 231 used in the above-described movement 100 is not used.

As a modified example, by changing the specification of IC, the step motor and the train wheel, in place of the ⅕ CG wheel 476 rotated by one step per ⅕ second, a 1 second CG wheel rotated by one step per 1 second, or a ½ CG wheel rotated by one step per ½ second or a ¼ CG wheel rotated by one step per ¼ second or the like can be provided.

(2•5) Constitution of Main Plate

In reference to FIG. 4, the minute-counting wheel lower bearing portion 102*k* is disposed at a position in the main plate 102, above the main plate reference horizontal axis line 304 and between the main plate center 300 and the outer shape portion 306 of the main plate 102 disposed in "6 o'clock direction" of the movement 400.

The ⅕ second rotor lower bearing portion 102*a*, the ⅕ CG intermediate wheel (A) lower bearing portion 102*fc*, and the ⅕ CG intermediate wheel (B) lower bearing portion 102*gc* are arranged at the third region 330 in the main plate 102.

The chronograph hour/minute rotor lower bearing portion 102*f*, the chronograph hour/minute fifth wheel & pinion lower bearing portion 102*g*, the minute-counter intermediate wheel (A) lower bearing portion 102*h*, the minute-counter intermediate wheel (B) lower bearing portion 102*j*, the hour-counter intermediate wheel (A) lower bearing portion 102*m* and the hour-counter intermediate wheel (B) lower bearing portion 102*n* are arranged at the third region 330 in the main plate 102.

The hour-counting wheel lower bearing portion 102*p* is disposed at a portion in the main plate 102, above the main plate reference vertical axis line 302 and between the main plate center 300 and the outer shape portion 309 of the main plate 102 disposed in "9 o'clock direction" of the movement 100.

The time rotor (B) lower bearing portion 102*r*, the hour fifth wheel & pinion (B) lower bearing portion 102*s*, the fourth wheel & pinion lower bearing portion for center 102*cc*, the third wheel & pinion lower bearing portion for center 102*dc*, the intermediate small second wheel (A) lower bearing portion 102*t*, the intermediate small second wheel (B) lower bearing portion 102*u* are arranged at the fourth region 340 in the main plate 102.

The small second wheel lower bearing portion 102*v* is disposed at a position in the main plate 102, above the main plate reference horizontal axis line 304 and between the main plate center 300 and the outer shape portion 312 of the main plate 102 disposed in "12 o'clock direction" of the movement 100.

The guide pin 170*p* is arranged at the first region 310. The guide pin 172*p* is arranged at the fourth region 340.

By constituting in this way, the main plate 102 used in the movement 400 can be made the same as the main plate 102 used in the movement 100. That is, the main plate can be used for the movement 400 as well as for the movement 100.

(2•6) Constitutions of Train Wheel Bridge (A) and Train Wheel Bridge (B)

In reference to FIG. 5, the ⅕ second rotor upper bearing portion 106*a*, the ⅕ CG intermediate wheel (A) upper bearing portion 102*fc*, and the ⅕ CG intermediate wheel (B) upper bearing portion 102*gc* are arranged at the third region 330 in the train wheel bridge (A) 106.

The chronograph hour/minute rotor upper bearing portion 107*f* and the chronograph hour/minute fifth wheel & pinion upper bearing portion 107*g* are arranged at the third region 330 in the train wheel bridge (B) 107.

The minute-counter intermediate wheel (A) upper bearing portion 106*h*, the minute-counter intermediate wheel (B) upper bearing portion 106*j*, the hour-counter intermediate wheel (A) upper bearing portion 106*m* and the hour-counter intermediate wheel (B) upper bearing portion 106*n* are arranged at the third region 330 in the train wheel bridge (A) 106.

The hour rotor (B) upper bearing portion 106*r*, the hour fifth wheel & pinion (B) upper bearing portion 102*s*, the fourth wheel & pinion upper bearing portion for center 102*cc* and the third wheel & pinion upper bearing portion for center 102*dc* are arranged at the fourth region 340 in the train wheel bridge (A) 106.

By constituting in this way, the train wheel bridge (A) 106 and the train wheel bridge (B) 107 used in the movement 400 can respectively be the same as the train wheel bridge (A) 106 and the train wheel bridge (B) 107 used in the above-described movement 100.

(2•7) Constitution of Back Train Wheel Bridge

In reference to FIG. 6, the minute-counting wheel upper bearing portion 108*k* is disposed in the back train wheel bridge 108, above the main plate reference horizontal axis line 304 and between the main plate center 300 and the outer shape portion of the back train wheel bridge 108 disposed in "6 o'clock direction" of the movement 400.

The minute-counter intermediate wheel (A) upper bearing portion 108*h*, the minute-counter intermediate wheel (B) upper bearing portion 108*j*, the hour-counter intermediate wheel (A) upper bearing portion 108*m* and the hour-counter intermediate wheel (B) upper bearing portion 108*n* are arranged at the third region 330 in the back train wheel bridge 108.

The hour-counting wheel upper bearing portion 108*p* is disposed at a position in the back train wheel bridge 108, above the main plate reference vertical axis line 302 and between the main plate center 300 and the outer shape portion of the back train wheel bridge 108 disposed in "9 o'clock direction" of the movement 400.

The intermediate small second wheel (A) upper bearing portion 108*t* and the intermediate small second wheel (B) upper bearing portion 108*u* are disposed at the fourth region 340 in the back train wheel bridge 108.

The small second wheel upper bearing portion 108*v* is disposed at a position in the back train wheel bridge 108, above the main plate reference horizontal axis line 304 and between the main plate center 300 and the outer shape portion of the back train wheel bridge 108 disposed in "12 o'clock direction of the movement 400.

By the foregoing construction, the back train wheel bridge 108 used in the movement 400 can be made the same as the back train wheel bridge 108 used in the above-described movement 100. That is, the back train wheel bridge can be used for the movement 400 as well as the movement 100.

(2•8) Arrangement of Parts in Movement

Next, a preferable arrangement of parts in the movement 400 will be explained.

In reference to FIG. 1, a rotation center 140*c* of the reset lever 140' is arranged at the second region 320. The train wheel setting lever 440 is arranged at the first region 310 and the fourth region 340. A position of the reset lever 140' brought into contact with the train wheel setting lever 440 is arranged at the first region 310. A position of the train wheel setting lever 440 for setting the intermediate small second wheel (B) 434 is arranged at the fourth region 340 on the back side of the movement 400. A position of the reset lever 140' for carrying out resetting operation is arranged at the second region 320 on the surface side of the movement 400. By constituting in this way, the train wheel setting lever 440 for firmly setting rotation of the train wheel for operating the small second hand can effectively be arranged on the surface side of the movement 400.

A coil block center 442*c* of the ⅕ second coil block 442 may be arranged at the third region 330. Rotation center of the ⅕ second rotor 446, rotation center of the ⅕ CG intermediate wheel (A) 470 and rotation center of the ⅕ CG intermediate wheel (B) 472 may be arranged at the third region 330. Rotation center of the minute wheel 226 may be arranged at the second region 320.

A coil block center 462*c* of the chronograph hour/minute coil block 462 may be arranged at the third region 330. Rotation center of the chronograph hour/minute rotor 466, rotation center of the chronograph hour/minute fifth wheel & pinion 450, rotation center of the minute-counter intermediate wheel (C) 451, rotation center of the minute-counter intermediate wheel (D) 453, rotation center of the hour-counter intermediate wheel (A) 452 and rotation center of the hour-counter intermediate wheel (B) 457 may be arranged at the third region 330. The coil block center 462*c* of the chronograph hour/minute coil block 462 is arranged on an outer side of the coil block center 442*c* of the ⅕ second coil block 442 in the third region 330. Rotation center of the chronograph hour-minute rotor 466 is arranged on an outer side of rotation center of the ⅕ second rotor 446 in the third region 330.

Rotation center of the minute-counting wheel 454 is disposed at a position above the main plate reference horizontal axis line 304 and between the main plate center 300 and the outer shape portion 306 of the main plate 102 disposed in "6 o'clock direction" of the movement 400. A distance between rotation center of the minute-counting wheel 454 and the main plate center 300 is preferably 30% through 70% of a radius of a maximum outer shape portion of the main plate 102, more preferably, 45% through 55% of the radius of the maximum outer shape portion of the main plate 102 and particularly preferably, about ½ of the radius of the maximum outer shape portion of the main plate 102.

Further, rotation center of the hour-counting wheel 458 is disposed at a position above the main plate reference vertical axis line 302 and between the main plate center 300 and the outer shape portion 309 of the main plate 102 disposed in "9 o'clock direction" of the movement. A distance between rotational center of the hour-counting wheel 458 and the main plate center 300 is preferably 30% through 70% of the radius of the maximum outer shape portion of the main plate 102, more preferably, 45% through 55% of the radius of the maximum outer shape portion of the main plate 102 and particularly preferably about ½ of the radius of the maximum outer shape portion of the main plate 102.

A coil block center 482*c* of the time coil block for center 482 may be arranged at the fourth region 340. Rotation center of the time rotor (B) 486, rotation center of the time fifth wheel & pinion (B) 420, rotation center of the small second intermediate wheel (A) 432, rotation center of the small second intermediate wheel (B) 434, rotation center of the fourth wheel & pinion for center 421, and rotation center of the third wheel & pinion for center 422 may be arranged at the fourth region 340. By constituting in this way, the plurality of coil blocks and the plurality of train wheels can effectively be arranged on the surface side of the movement. Here, a number of parts constituting the train wheels is not limited to the above-described but one or more of transmission wheels may further be added.

Rotation center of the small second wheel 436 is disposed at a position above the main plate reference horizontal axis line 304 and between the main plate center 300 and the outer shape portion 312 of the main plate 102 disposed in "12 o'clock direction" of the movement 400. A distance between rotation center of the small second wheel 436 and the main plate center 300 is preferably 30% through 70% of the radius of the maximum outer shape portion of the main plate 102, more preferably, 45% through 55% of the radius of the maximum outer shape portion of the main plate 102 and particularly preferably, about ½ of the radius of the maximum outer shape portion of the main plate 102.

It is preferable to constitute all of the distance between rotation center of the minute-counting wheel 454 and the main plate center 300, the distance between rotation center of the hour-counting wheel 458 and the main plate center 300 and the distance between rotation center of the small second wheel 436 and the main plate center 300 to be an equal value.

(2•9) Operation of Second Embodiment

Next, an explanation will be given of operation of the second embodiment of the analog electronic timepiece (analog chronograph timepiece) according to the invention.

Figure 13:
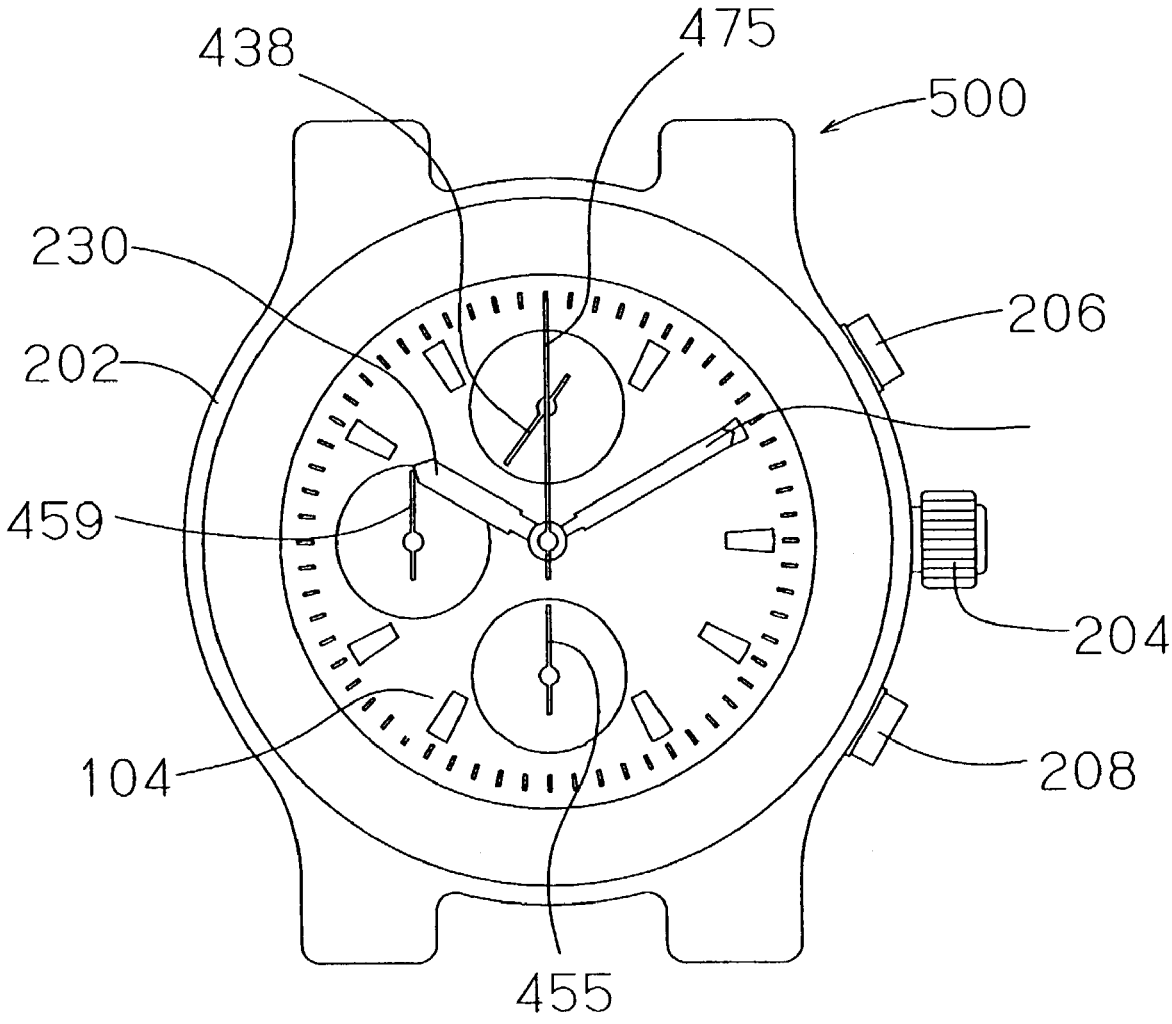
FIG. 13 is a plane view showing an outline shape of a complete of the center chronograph timepiece according to the embodiment of the chronograph timepiece of the invention.

In reference to FIG. 13, a complete 500 of the center chronograph time piece is provided with the outer case 202. The outer case 202 used in the second embodiment of the analog chronograph timepiece according to the invention may be the same as the outer case 202 used in the above-described first embodiment of the analog chronograph timepiece of the invention or may be different therefrom. The movement 400 and the dial 104 are contained in the outer case 202. The dial 104 used in the second embodiment of the analog chronograph timepiece of the invention may be the same as the dial 104 used in the above-described first embodiment of the analog chronograph timepiece of the invention or may be different therefrom.

The crown 204 is provided at the outer case 202 to rotate integrally with the hand setting stem 110. Time of the center chronograph time piece is constituted to be able to set by pulling out the crown 204 to the first stage and rotating the crown 204. That is, when the crown 204 is pulled out to the first stage, the small second hand 438 is constituted to be able to stop and the hour hand 230 and the minute hand 232 are constituted to be able to rotate by rotating the crown 204.

The outer case 202 is provided with the start/stop button 206 for starting or stopping operation of chronograph of the center chronograph timepiece. Signals with regard to starting operation and stopping operation of the chronograph are constituted to transmit to IC 116 by operating the switch spring when the start/stop button 206 is pushed. The outer case 202 is provided with the reset button 208 for resetting operation of chronograph of the center chronograph timepiece. A signal with regard to resetting operation of chronograph is constituted to transmit to IC 116 by operating the switch spring when the reset button 208 is pushed.

Here, operation of indicating current time will be explained. In reference to FIG. 9 through FIG. 13, time of the center chronograph timepiece is set to current time by pulling out the crown 204 to the first stage and rotating the crown 204 and the crown 204 is pushed to zero stage. Under the state, the time rotor (B) 486 is rotated and the time fifth wheel & pinion (B) 420 is rotated based on rotation of the time rotor (B) 486. The small second wheel 436 is rotated based on rotation of the time fifth wheel & pinion (B) 420 via rotation of the intermediate small second wheel (A) 432 and the intermediate small second wheel (B) 434. The small second wheel 436 is rotated by one rotation per minute and therefore, the small second hand 438 attached to the small second wheel 436 indicates "second" of current time.

Further, the center wheel & pinion for center 424 is rotated based on rotation of the time fifth wheel & pinion (B) 420 via rotation of the fourth wheel & pinion for center 421 and the third wheel & pinion for center 422. The center wheel & pinion for center 424 is rotated by one rotation per hour and therefore, the minute hand 232 attached to the cannon pinion for center 424*b* of the center wheel & pinion for center 424 indicates "minute" of current time.

Further, the hour wheel 228 is rotated based on rotation of the center wheel & pinion for center 424 via rotation of the minute wheel 226. The hour wheel 228 is rotated by one rotation per 12 hours and therefore, the hour hand 234 attached to the hour wheel 228 indicates "hour" of current time.

Next, operation of measurement of chronograph will be explained. In reference to FIG. 13, in a state of stopping to reset measurement of chronograph, all of the hour chronograph hand 459, the minute chronograph hand 455 and the ⅕ second chronograph hand 475 are disposed at "zero positions (initial positions)". That is, in the reset state, all of the hour chronograph hand 459, the minute chronograph hand 455, the ⅕ second chronograph hand 475 are disposed at positions indicating "zero".

In reference to FIG. 9 through FIG. 13, the chronograph measuring mode is started by pushing the start/stop button 206 to start measurement of chronograph. In the chronograph measuring mode, the chronograph hour/minute rotor 466 is rotated and the chronograph hour/minute fifth wheel & pinion 450 is rotated based on rotation of the chronograph hour/minute rotor 466. Further, the minute-counter intermediate wheel (C) 451 and the hour-counter intermediate wheel (A) 452 are rotated based on rotation of the chronograph hour/minute fifth wheel & pinion 250. The minute-counting wheel 454 is rotated based on rotation of the minute-counter intermediate wheel (C) 451 via rotation of the minute-counter intermediate wheel (D) 453. In the chronograph measuring mode, the minute chronograph hand 455 attached to the minute-counting wheel 454 indicates "minute" in elapse time.

Further, the hour-counting wheel 458 is rotated based on rotation of the hour-counter intermediate wheel (A) 452 via rotation of the hour-counter intermediate wheel (B) 457. In the chronograph measuring mode, the hour chronograph hand 459 attached to the hour-counting wheel 458 indicates "hour" in elapse time.

Further, in the chronograph measuring mode, the ⅕ second rotor 446 is rotated and the ⅕ CG intermediate wheel (A) 470 is rotated based on rotation of the ⅕ second rotor 446. The ⅕ CG wheel 476 is rotated based on rotation of the ⅕ CG intermediate wheel (A) 470 via rotation of the ⅕ CG intermediate wheel (B) 472. In the chronograph measuring mode, the ⅕ second chronograph hand 475 attached to the ⅕0 CG wheel 476 is operated to indicate "second" in elapse time by "⅕ second unit".

Further, in the chronograph measuring mode, when the start/stop button 206 is pushed, measurement of chronograph can be stopped. In the state of stopping to measure chronograph, the our chronograph hand 459 is stopped in a state of indicating "hour" in elapse time, the minute chronograph hand 455 is stopped in a state of indicating "minute" in elapse time and the ⅕ second chronograph hand 475 is stopped in a state of indicating "second" in elapse time by "⅕ second unit".

In the state of stopping to measure chronograph, when the reset button 208 is pushed, all of the hour chronograph hand 459, the minute chronograph hand 455 and the ⅕ second chronograph hand 475 return to positions indicating "zero" (refer to FIG. 8).

(3) Other Embodiment

Next, other embodiment of the invention will be explained.

The following explanation will mainly be given of a point of other embodiment of the invention different from the first embodiment of the invention and a point of other embodiment different from the second embodiment of the invention. Therefore, with regard to a portion other than content described below, the above-described explanation with regard to the first embodiment of the invention and the above-described explanation with regard to the second embodiment of the invention will be applied thereto.

(3•1) Constitution of Movement of Side Chronograph Timepiece

In the above-described movement 100 of the side chronograph timepiece, although parts constituting the movement 100 are preferably arranged to constitute a structure shown in FIG. 1 relative to the main plate reference vertical axis line 302, the parts constituting the movement may be arranged to constitute a structure in mirror symmetry with the structure shown in FIG. 1 relative to the main plate reference vertical axis line 302.

Figure 14:
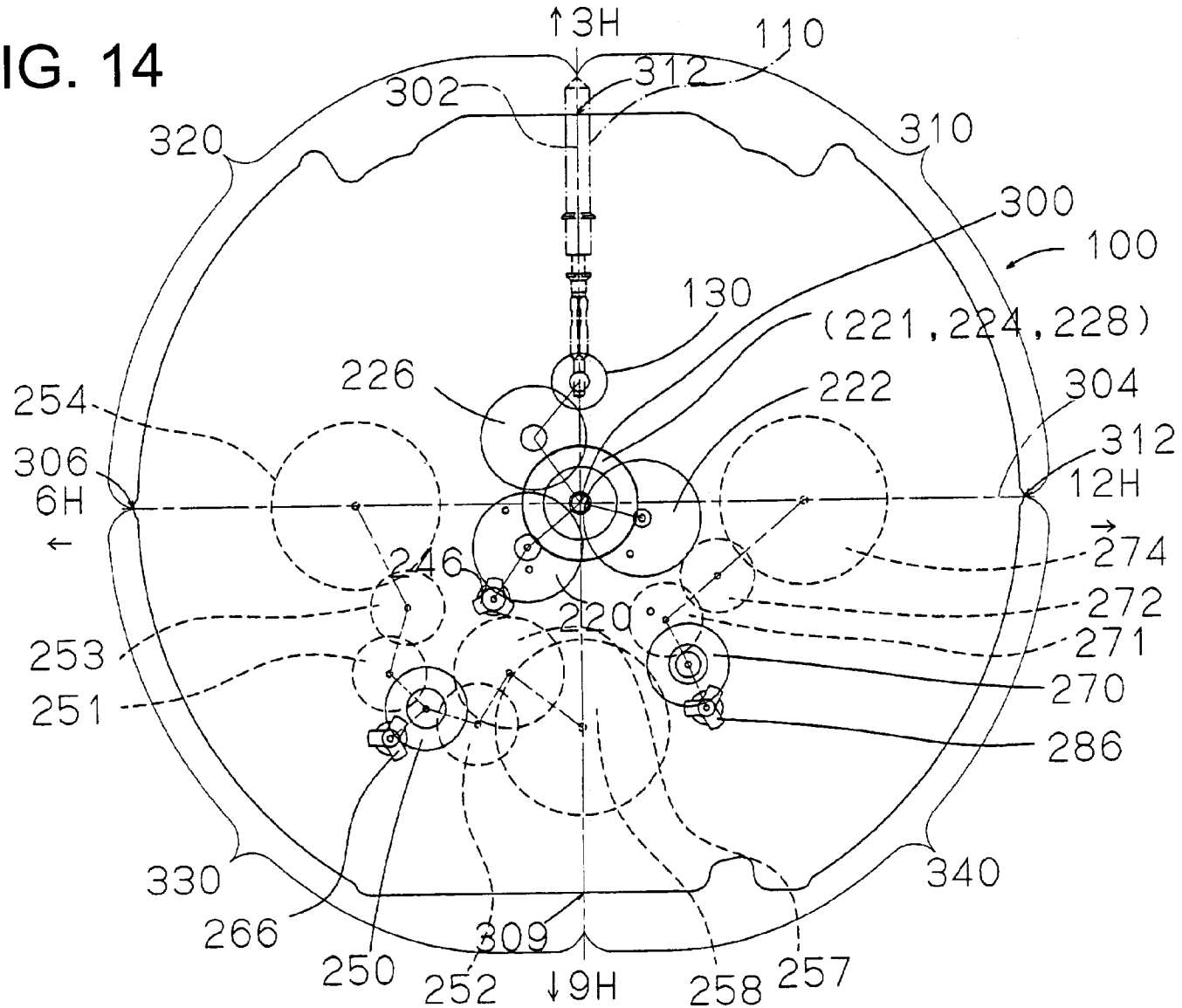
FIG. 14 is a plane view showing an outline arrangement of the motor and the train wheel of the movement of the side chronograph timepiece according to the embodiment of the chronograph timepiece of the invention (in FIG. 14, illustration of portions of parts is omitted)

That is, in reference to FIG. 1 and FIG. 14, in the movement 100, the coil block center 242*c* of the time coil block for side 242 is arranged at the third region 330. Rotation center of the time rotor (A) 246 and rotation center of the time fifth wheel & pinion (A) 220 are arranged at the third region 330. Rotation center of the third wheel & pinion for side 222 is arranged at the fourth region 340. Rotation center of the minute wheel 226 is arranged at the second region 320.

The coil block center 262*c* of the chronograph minute/second coil block 262 is arranged at the third region 330. Rotation center of the chronograph minute/second rotor 266, rotation center of the chronograph minute/second fifth wheel & pinion 250, rotation center of the second-counter intermediate wheel (A) 251, rotation center of the minute-counter intermediate wheel (A) 252, rotation center of the second-counter intermediate wheel (B) 253 and rotation center of the minute-counter intermediate wheel (B) 257 are arranged at the third region 330. The coil block center 262*c* of the chronograph minute-second coil block 262 is arranged on the outer side of the coil block center 242*c* of the time coil block for side 242 in the third region 330. Rotation center of the chronograph minute/second rotor 266 is arranged on the outer side of rotation center of the time rotor (A) 246 in the third region 330.

Rotation center of the second-counting wheel 254 is disposed at a position above the main plate reference horizontal axis line 304 and between the main plate center 300 and the outer shape portion 306 of the main plate 102 disposed in "6 o'clock direction" of the movement 100.

Further, rotation center of the minute-counting wheel 258 is disposed at a position above the main plate reference vertical axis line 302 and between the main plate center 300 and the outer shape portion 309 of the main plate 102 disposed in "9 o'clock direction" of the movement 100.

The coil block center 282*c* of the 1/10 second coil block 282 is arranged at the fourth region 340. Rotation center of the 1/10 second rotor 286, rotation center of the 1/10 second fifth wheel & pinion 270, rotation center of the 1/10 second-counter intermediate wheel (A) 271 and rotation center of the 1/10 second-counter intermediate wheel (B) 272 are arranged at the fourth region 340.

Rotation center of the 1/10 second-counting wheel 274 is disposed at a position above the main plate reference horizontal axis line 304 and between the main plate center 300 and the outer shape portion 312 of the main plate 102 disposed in "12 o'clock direction" of the movement 100.

All of the distance between rotation center of the second-counting wheel 254 and the main plate center 300, the distance between rotation center of the minute-counting wheel 258 and the main plate center 300 and the distance between rotation center of the 1/10 second-counting wheel 274 and the main plate center 300 are constituted to be an equal value.

Figure 15:
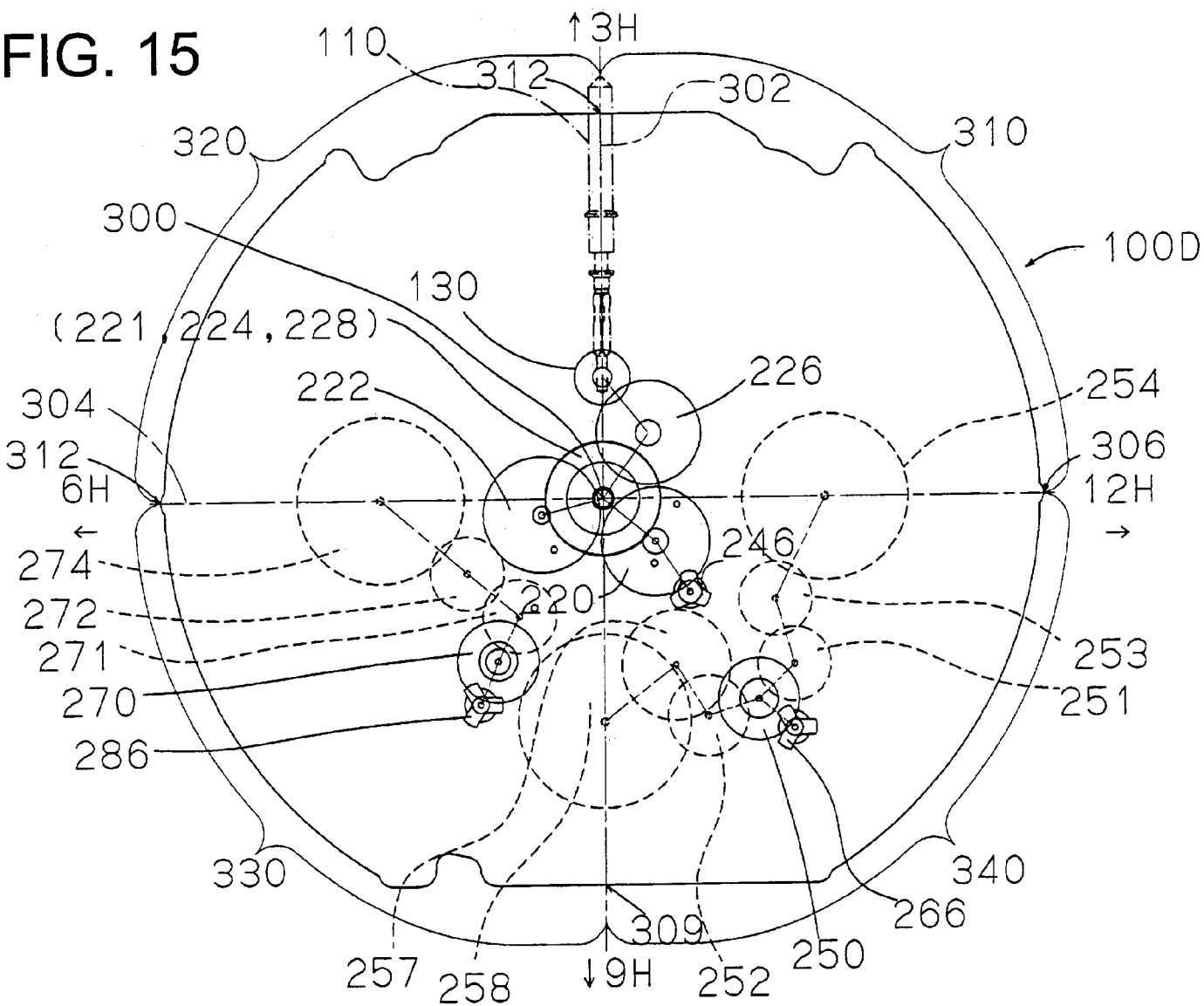
FIG. 15 is a plane view showing an outline arrangement of a motor and a train wheel of a movement of a side chronograph timepiece according to other embodiment of an chronograph timepiece of the invention (in FIG. 15, illustration of portions of parts are omitted)

In contrast thereto, in reference to FIG. 15, there may be constructed a constitution in a movement 100D such that rotation center of the time rotor (A) 246 and rotation center of the time fifth wheel & pinion (A) 220 are arranged at the fourth region 340, rotation center of the third wheel & pinion for side 222 is arranged at the third region 330, rotation center of the minute wheel 226 is arranged at the first region 310, rotation center of the chronograph minute/second rotor 266, rotation center of the chronograph minute/second-fifth wheel & pinion 250, rotation center of the second-counter intermediate wheel (A) 251, rotation center of the minute-counter intermediate wheel (A) 252, rotation center of the second-counter intermediate wheel (B) 253 and rotation center of the minute-counter intermediate wheel (B) 257 are arranged at the fourth region 340 and rotation center of the 1/10 second rotor 286, rotation center of the 1/10 second fifth wheel & pinion 270, rotation center of the 1/10 second-counter intermediate wheel (A) 271 and rotation center of the 1/10 second-counter intermediate wheel (B) 272 are arranged at the third region 330.

Further, in the movement 100D, rotation center of the second-counting wheel 254 is disposed at a position above the main plate reference horizontal axis line 304 and between the main plate center 300 and the outer shape portion 312 of the main plate 102*d* disposed in "12 o'clock direction" of the movement 100, rotation center of the minute-counting wheel 258 is disposed at a position above the main plate reference vertical axis line 302 and between the main plate center 300 and the outer shape portion 309 of the main plate 102D disposed in "9 o'clock direction" of the movement 100D and rotation center of the 1/10 second-counting wheel 274 is disposed at a position above the main plate reference horizontal axis line 304 and between the main plate center 300 and the outer shape portion 306 of the main plate 102D disposed in "6 o'clock direction" of the movement 100.

(3•2) Constitution of Movement of Center Chronograph Timepiece

In the above-described movement 400 of the center chronograph timepiece, although parts constituting the movement 400 are preferably arranged to constitute a structure shown in FIG. 9 relative to the main plate reference vertical axis line 302, the parts constituting the movement may be arranged to constitute a structure in mirror symmetry with the structure shown in FIG. 9 relative to the main plate reference vertical axis line 302.

Figure 16:
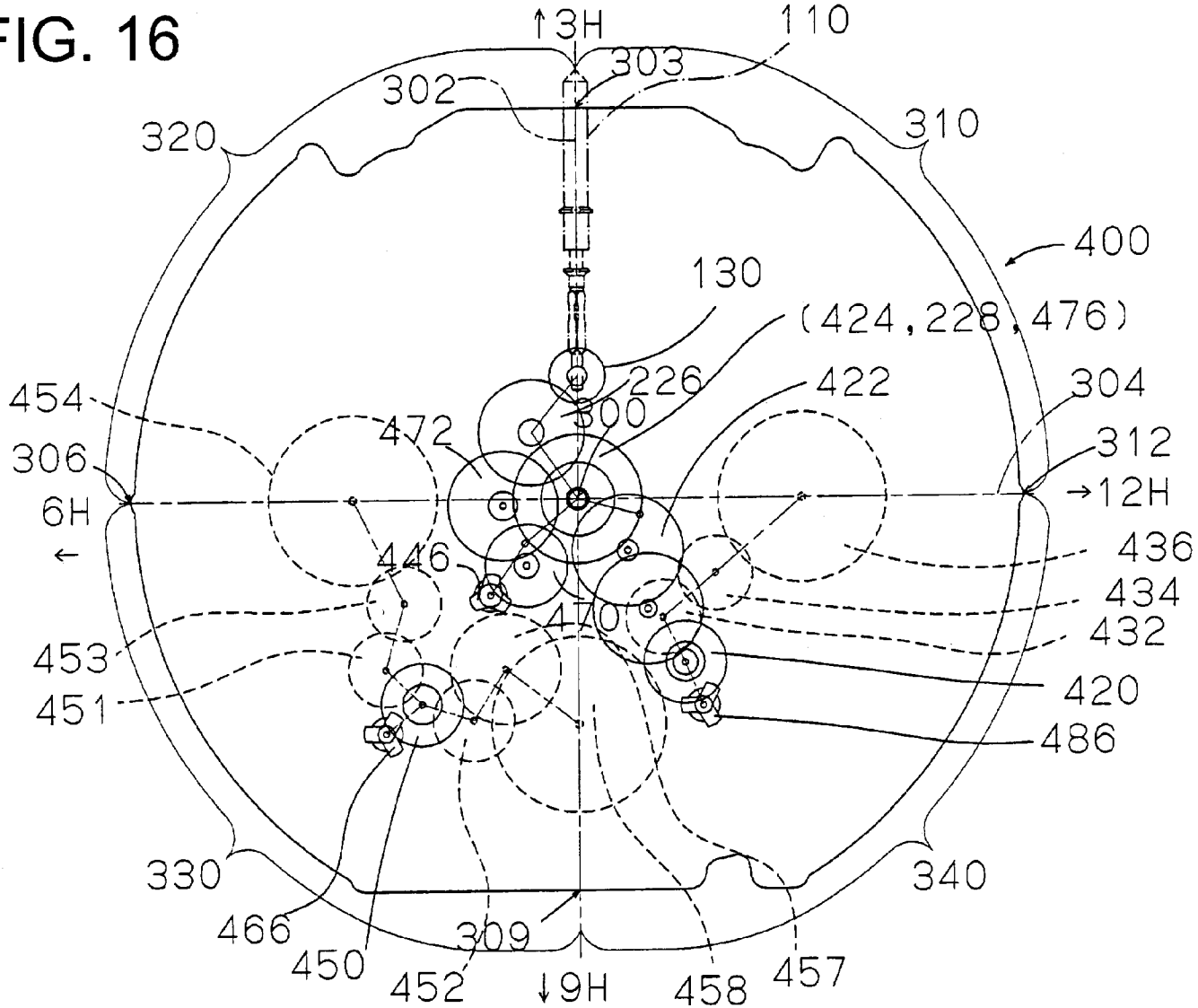
FIG. 16 is a plane view showing an outline arrangement of a motor and a train wheel in the movement of the center chronograph timepiece according to the embodiment of the analog chronograph of the invention (in FIG. 16, illustration of portions of parts is omitted)

That is, in reference to FIG. 9 and FIG. 16, in the movement 400, the coil block center 442*c* of the 1/5 second coil block 442 is arranged at the third region 330. Rotation center of the 1/5 second rotor 446, rotation center of the 1/5 CG intermediate wheel (B) 470 and rotation center of the 1/5 CG intermediate wheel (B) 472 are arranged at the third region 330. Rotation center of the minute wheel 226 is arranged at the second region 320.

The coil block center 462*c* of the chronograph hour/minute coil block 462 is arranged at the third region 330. Rotation center of the chronograph hour/minute rotor 466, rotation center of the chronograph hour/minute fifth wheel & pinion 450, rotation center of the minute/counter intermediate wheel (C) 451, rotation center of the minute-counter intermediate wheel (D) 453, rotation center of the hour-counter intermediate wheel (A) 452 and rotation center of the hour-counter intermediate wheel (B) 457 are arranged at the third region 330. The coil block center 462*c* of the chronograph hour/minute coil block 462 is arranged on the outer side of the coil block center 442*c* of the 1/5 second coil block 442 in the third region 330. Rotation center of the chronograph hour/minute rotor 466 is arranged on the outer side of rotation center of the 1/5 second rotor 446 in the third region 330.

Rotation center of the minute-counting wheel 454 is disposed at a position above the main plate reference horizontal axis line 304 and between the main plate center 300 and the outer shape portion 306 of the main plate 102 disposed in "6 o'clock direction" of the movement 400.

Further, rotation center of the hour-counting wheel 458 is disposed at a position above the main plate reference vertical axis line 302 and between the main plate center 300 and the outer shape portion 309 of the main plate 102 disposed in "9 o'clock direction" of the movement 400.

The coil block center 482*c* of the time coil block for center 482 is arranged at the fourth region 340. Rotation center of the time rotor (B) 486, rotation center of the time fifth wheel & pinion (B) 420, rotation center of the intermediate small second wheel (A) 432, rotation center of the intermediate small second wheel (B) 434, rotation center of the fourth wheel & pinion for center 421 and rotation center of the third wheel & pinion for center 422 are disposed at the fourth region 340.

Rotation center of the small second wheel 436 is disposed at a position above the main plate reference horizontal axis line 304 and between the main plate center 300 and the outer shape portion 312 of the main plate 102 disposed in "12 o'clock direction" of the movement 400.

All of the distance between rotation center of the minute-counting wheel 454 and the main plate center 300, the distance between rotation center of the hour-counting wheel 458 and the main plate center 300 and the distance between rotation center of the small second wheel 436 and the main plate center 300 are constituted to be an equal value.

Figure 17:
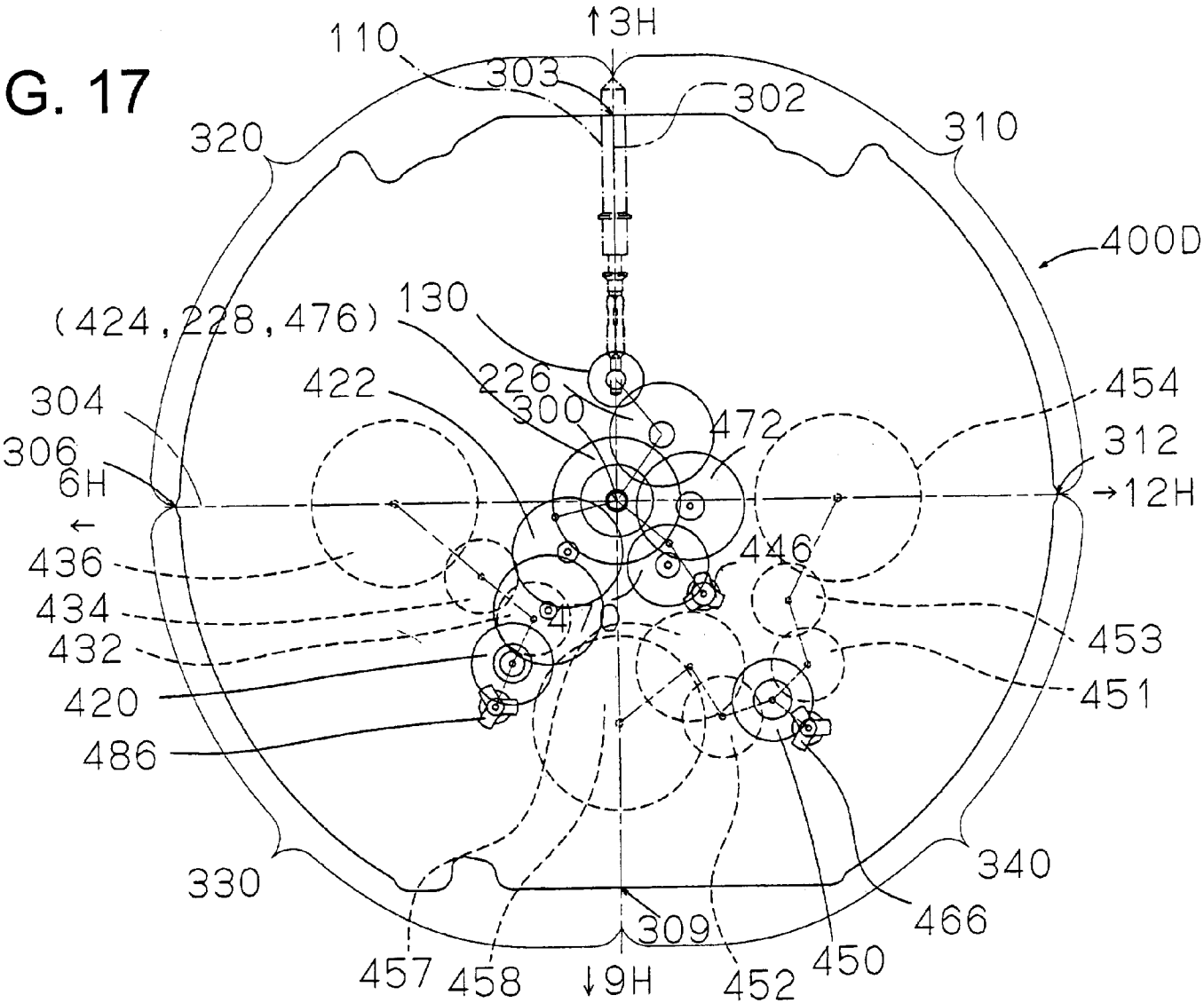
FIG. 17 is a plane view showing an outline arrangement of a motor and a train wheel in a movement of a center chronograph timepiece according to other embodiment of the chronograph timepiece of the invention (in FIG. 17, illustration of portions of parts is omitted).

In contrast thereto, in reference to FIG. 17, in the movement 400D, there may be constructed a constitution such that rotation center of the ⅕ second rotor 446, rotation center of the ⅕ CG intermediate wheel (A) 470, and rotation center of the ⅕ CG intermediate wheel (B) 472 are arranged at the second region 320, rotation center of the minute wheel 226 is arranged at the first region 310, rotation center of the chronograph hour/minute rotor 466, rotation center of the chronograph hour/minute fifth wheel & pinion 450, rotation center of the minute-counter intermediate wheel (C) 451, rotation center of the minute-counter intermediate wheel (D) 453, rotation center of the hour-counter intermediate wheel (A) 452 and rotation center of the hour-counter intermediate wheel (B) 457 are arranged at the second region 320, rotation center of the time rotor (B) 486, rotation center of the time fifth wheel &pinion (B) 420, rotation center of the intermediate small second wheel (A) 432, rotation center of the intermediate small second wheel (B) 434, rotation center of the fourth wheel & pinion for center 421 and rotation center of the third wheel & pinion for center 422 are arranged at the third region 330.

In the movement 400D, rotation center of the minute-counting wheel 454 is disposed at a position above the main plate reference horizontal axis line 304 and between the main plate center 300 and the outer shape portion 312 of the main plate 102D disposed in "12 o'clock direction" of the movement 400D, rotation center of the hour-counting wheel 458 is disposed at a position above the main plate reference vertical axis line 302 and between the main plate center 300 and the outer shape portion 309 of the main plate 102D disposed in "9 o'clock direction" of the movement 400D and rotation center of the small second wheel 436 is disposed at a position above the main plate reference horizontal axis line 304 and between the main plate center 300 and the outer shape portion 312 of the main plate 102D disposed in "12 o'clock direction" of the movement 400D.

By the foregoing construction of the present invention, constituent parts of a movement for a "center chronograph timepiece" can also be used as constituent parts of a movement for a "side chronograph timepiece" and therefore, cost of designing a movement, cost of fabricating a movement, cost of after service of a chronograph timepiece and the like can remarkably be reduced.

What is claimed is:

1. An analog chronograph timepiece comprising:

a main plate;

a movement comprising a time information indicating wheel mounted on the main plate to undergo rotation about a rotational center of the main plate, and a plurality of time indicating hands disposed over a dial and connected to the time information indicating wheel for rotation therewith to indicate time information; and a hand setting stem for correcting time information indicated by the time indicating hands;

wherein a main plate reference vertical axis line passing through the rotational center of the main plate and disposed parallel to a central axis line of the hand setting stem and a main plate reference horizontal axis line passing through the rotational center of the main plate and disposed orthogonal to the main plate reference vertical axis line are defined at the main plate;

wherein the main plate has a first region disposed on a first side of the main plate reference vertical axis line and on a side of the main plate reference horizontal axis line proximate to the hand setting stem, a second region disposed on a second side of the main plate reference vertical axis line and on the side of the main plate reference horizontal axis line proximate to the hand setting stem, a third region disposed on the second side of the main plate reference vertical axis line where the second region is present and on a side of the main plate reference horizontal axis line remote from the hand setting stem, and a fourth region disposed on the first side of the main plate reference vertical axis line where the first region is present and on the side of the main plate reference horizontal axis line remote from the hand setting stem;

wherein a coil block center of a time coil block for operating a motor and a train wheel for indicating the time information is arranged at the third region of the main plate;

wherein a coil block center of a first chronograph coil block for operating a motor and a train wheel for indicating a chronograph measurement is arranged at the third region of the main plate;

wherein a coil block center of a second chronograph coil block for operating a motor and a train wheel for indicating another chronograph measurement is arranged at the fourth region of the main plate; and wherein the coil block center of the first chronograph coil block is arranged on an outer side of the coil block center of the time coil block.

2. An analog chronograph timepiece according to claim 1; wherein the time indicating hands comprise current time second, minute and hour hands concentrically mounted at the rotational center of the main plate; and further comprising chronograph second, minute and hour hands disposed around the rotational center of the main plate.

3. An analog chronograph timepiece according to claim 1; wherein the time indicating hands comprise current time second, minute and hour hands the current time minute and hour hands being mounted at the rotational center of the main plate and the current time second hand being disposed around the rotational center of the main plate; and further comprising a chronograph second hand mounted at the rotational center of the main plate and chronograph minute and hour hands disposed around the rotational center of the main plate.

4. An analog chronograph timepiece according to claim 1; further comprising a crystal unit and/or an integrated circuit arranged on a surface side of the movement at the second region of the main plate.

5. An analog chronograph timepiece according to claim 1, further comprising a battery overlapping the main plate reference horizontal axis line between the first and fourth regions of the main plate.

6. An analog chronograph timepiece according to claim 1; further comprising a bridge member for supporting the movement.

7. An analog chronograph timepiece according to claim 6; further comprising a switching apparatus for switching a position of the hand setting stem.

8. An analog chronograph timepiece comprising:

a main plate;

a movement comprising a time information indicating wheel mounted on the main plate to undergo rotation about a rotational center of the main plate, and a plurality of time indicating hands disposed over a dial and connected to the time information indicating wheel for rotation therewith to indicate time information; and a hand setting stem for correcting time information indicated by the time indicating hands;

wherein a main plate reference vertical axis line passing through the rotational center of the main plate and disposed parallel to a central axis line of the hand setting stem and a main plate reference horizontal axis line passing through the rotational center of the main plate and disposed orthogonal to the main plate reference vertical axis line are defined at the main plate;

wherein the main plate has a first region disposed on a first side of the main plate reference vertical axis line and on a side of the main plate reference horizontal axis line proximate to the hand setting stem, a second region disposed on a second side of the main plate reference vertical axis line and on the side of the main plate reference horizontal axis line proximate to the hand setting stem, a third region disposed on the second side of the main plate reference vertical axis line where the second region is present and on a side of the main plate reference horizontal axis line remote from the hand setting stem, and a fourth region disposed on the first side of the main plate reference vertical axis line where the first region is present and on the side of the main plate reference horizontal axis line remote from the hand setting stem;

wherein a rotation center of a time rotor for operating a train wheel for indicating the time information is arranged at the third region of the main plate;

wherein a rotation center of a first chronograph rotor for operating a first train wheel for indicating a chronograph measurement is arranged at the third region of the main plate;

wherein a rotation center of a second chronograph rotor for operating a second train wheel for indicating another chronograph measurement is arranged at the fourth region of the main plate; and wherein the rotation center of the first chronograph rotor is arranged on an outer side of the rotation center of the time rotor.

9. An analog chronograph timepiece according to claim 8; wherein the time indicating hands comprise current time second, minute and hour hands concentrically mounted at the rotational center of the main plate; and further comprising chronograph second, minute and hour hands disposed around the rotational center of the main plate.

10. An analog chronograph timepiece according to claim 8; wherein the time indicating hands comprise current time second, minute and hour hands, the current time minute and hour hands being mounted at the rotational center of the main plate and the current time second hand being disposed around the rotational center of the main plate; and further comprising a chronograph second hand mounted at the rotational center of the main plate and chronograph minute and hour hands disposed around the rotational center of the main plate.

11. An analog chronograph timepiece according to claim 8; further comprising a crystal unit and/or an integrated circuit arranged on a surface side of the movement at the second region of the main plate.

12. An analog chronograph timepiece according to claim 8; further comprising a battery overlapping the main plate reference horizontal axis line between the first and fourth regions of the main plate.

13. An analog chronograph timepiece according to claim 8; further comprising a bridge member for supporting the movement.

14. An analog chronograph timepiece according to claim 13; further comprising a switching apparatus for switching a position of the hand setting stem.

15. An analog chronograph timepiece comprising:

a main plates;

a movement comprising a time information indicating wheel mounted on the main plate to undergo rotation about a rotational center of the main plate, and a plurality of time indicating hands disposed over a dial and connected to the time information indicating wheel for rotation therewith to indicate time information; and a hand setting stem for correcting time information indicated by the time indicating hands;

wherein a main plate reference vertical axis line passing through the rotational center of the main plate and disposed parallel to a central axis line of the hand setting stem and a main plate reference horizontal axis line passing through the rotational center of the main plate and disposed orthogonal to the main plate reference vertical axis line are defined at the main plate;

wherein the main plate has a first region disposed on a first side of the main plate reference vertical axis line and on a side of the main plate reference horizontal axis line proximate to the hand setting stem, a second region disposed on a second side of the main plate reference vertical axis line and on the side of the main plate reference horizontal axis line proximate to the hand setting stem, a third region disposed on the second side of the main plate reference vertical axis line where the second region is present and on a side of the main plate reference horizontal axis line remote from the hand setting stem, and a fourth region disposed on the first side of the main plate reference vertical axis line where the first region is present and on the side of the main plate reference horizontal axis line remote from the hand setting stem;

wherein a coil block center of a time coil block for operating a motor and a train wheel for indicating the time information is arranged at the fourth region of the main plate;

wherein a coil block center of a first chronograph coil block operating a motor and a train wheel for indicating a chronograph measurement is arranged at the third region of the main plate;

wherein a coil block center of a second chronograph coil block for operating a motor and a train wheel for indicating another chronograph measurement is arranged at the third region; and wherein the coil block center of the first chronograph coil block is arranged on an outer side of the coil block center of the second chronograph coil block third region.

16. An analog chronograph timepiece according to claim 15; wherein the time indicating hands comprise current time second, minute and hour hands concentrically mounted at the rotational center of the main plate; and further comprising chronograph second, minute and hour hands disposed around the rotational center of the main plate.

17. An analog chronograph timepiece according to claim 15; wherein the time indicating hands comprise current time second, minute and hour hands, the current time minute and hour hands being mounted at the rotational center of the main plate and the current time second hand being disposed around the rotational center of the main plate; and further comprising a chronograph second hand mounted at the rotational center of the main plate and chronograph minute and hour hands disposed around the rotational center of the main plate.

18. An analog chronograph timepiece according to claim 15; further comprising a crystal unit and/or an integrated circuit arranged on a surface side of the movement at the second region of the main plate.

19. An analog chronograph timepiece according to claim 15; further comprising a battery overlapping the main plate reference horizontal axis line between the first and fourth regions of the main plate.

20. An analog chronograph timepiece according to claim 15; further comprising a bridge member for supporting the movement.

21. An analog chronograph timepiece according to claim 20; further comprising a switching apparatus for switching a position of the hand setting stem.

22. An analog chronograph timepiece comprising:

a main plates;

a movement comprising a time information indicating wheel mounted on the main plate to undergo rotation about a rotational center of the main plate, and a plurality of time indicating hands disposed over a dial and connected to the time information indicating wheel for rotation therewith to indicate time information; and a hand setting stem for correcting time information indicated by the time indicating hands;

wherein a main plate reference vertical axis line passing through the rotational center of the main plate and disposed parallel to a central axis line of the hand setting stem and a main plate reference horizontal axis line passing through the rotational center of the main plate and disposed orthogonal to the main plate reference vertical axis line are defined at the main plate;

wherein the main plate has a first region disposed on a first side of the main plate reference vertical axis line and on a side of the main plate reference horizontal axis line proximate to the hand setting stem, a second region disposed on a second side of the main plate reference vertical axis line and on the side of the main plate reference horizontal axis line proximate to the hand setting stem, a third region disposed on the second side of the main plate reference vertical axis line where the second region is present and on a side of the main plate reference horizontal axis line remote from the hand setting stem, and a fourth region disposed on the first side of the main plate reference vertical axis line where the first region is present and on the side of the main plate reference horizontal axis line remote from the hand setting stem;

wherein a rotation center of a time rotor for operating a train wheel for indicating the time information is arranged at the fourth region of the main plate;

wherein a rotation center of a first chronograph rotor for operating a first train wheel for indicating a chronograph measurement is arranged at the third region of the main plate;

wherein a rotation center of a second chronograph rotor for operating a second train wheel for indicating another chronograph measurement is arranged at the third region of the main plate; and wherein the rotation center of the first chronograph rotor is arranged on an outer side of the rotation center of the second chronograph rotor.

23. An analog chronograph timepiece according to claim 22; wherein the time indicating hands comprise current time second, minute and hour hands concentrically mounted at the rotational center of the main plate; and further comprising chronograph second, minute and hour hands disposed around the rotational center of the main plate.

24. An analog chronograph timepiece according to claim 22; wherein the time indicating hands comprise current time second, minute and hour hands, the current time minute and hour hands being mounted at the rotational center of the main plate and the current time second hand being disposed around the rotational center of the main plate; and further comprising a chronograph second hand mounted at the rotational center of the main plate and chronograph minute and hour hands disposed around the rotational center of the main plate.

25. An analog chronograph timepiece according to claim 22; further comprising a crystal unit and/or an integrated circuit arranged on a surface side of the movement at the second region of the main plate.

26. An analog chronograph timepiece according to claim 22, further comprising a battery overlapping the main plate reference horizontal axis line between the first and fourth regions of the main plate.

27. An analog chronograph timepiece according to claim 22; further comprising a bridge member for supporting the movement.

28. An analog chronograph timepiece according to claim 27; further comprising a switching apparatus for switching a position of the hand setting stem.

* * * * *